US008573308B2

(12) United States Patent
Baugh

(10) Patent No.: US 8,573,308 B2
(45) Date of Patent: Nov. 5, 2013

(54) RISER CENTRALIZER SYSTEM (RCS)

(75) Inventor: Benton F. Baugh, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 679 days.

(21) Appl. No.: 12/549,900

(22) Filed: Aug. 28, 2009

(65) Prior Publication Data

US 2010/0147528 A1 Jun. 17, 2010

Related U.S. Application Data

(60) Provisional application No. 61/095,338, filed on Sep. 9, 2008.

(51) Int. Cl.
*E21B 29/12* (2006.01)
*E21B 17/01* (2006.01)

(52) U.S. Cl.
USPC ..... 166/355; 166/367

(58) Field of Classification Search
USPC ..... 166/339, 367, 378–380, 241.6, 242.1, 166/345, 350, 352, 355; 405/169, 170, 405/184.5
See application file for complete search history.

(56) References Cited

U.S. PATENT DOCUMENTS

| | | | | |
|---|---|---|---|---|
| 3,142,343 | A | 7/1964 | Otteman et al. | |
| 3,145,775 | A | 8/1964 | McCarty | |
| 3,456,745 | A | 7/1969 | Peri | |
| 3,503,460 | A | 3/1970 | Gadbois | |
| 3,528,497 | A * | 9/1970 | Lehman | 166/360 |
| 4,053,022 | A | 10/1977 | Mercier | |
| 4,198,179 | A | 4/1980 | Pease et al. | |
| 4,423,983 | A | 1/1984 | Dadiras et al. | |
| 4,469,181 | A | 9/1984 | Kellett | |
| 4,505,614 | A | 3/1985 | Anschutz | |
| 4,616,708 | A | 10/1986 | da Mota | |
| 4,617,998 | A * | 10/1986 | Langner | 166/345 |
| 4,694,909 | A * | 9/1987 | Stephenson et al. | 166/356 |
| 4,733,991 | A * | 3/1988 | Myers | 405/224.2 |
| 4,844,660 | A | 7/1989 | Ortemond | |
| 5,158,397 | A | 10/1992 | Koos et al. | |
| 5,479,990 | A * | 1/1996 | Peppel | 166/350 |
| 5,551,803 | A | 9/1996 | Pallini, Jr. et al. | |

(Continued)

FOREIGN PATENT DOCUMENTS

DE 11902 5/1902

OTHER PUBLICATIONS

Baugh, Benton, "BOP Tools: Overview," Radoll Catalog, 2002, Radoll, Houston, Texas.

(Continued)

*Primary Examiner* — Matthew Buck
*Assistant Examiner* — James Sayre
(74) *Attorney, Agent, or Firm* — Jayne C. Piana

(57) ABSTRACT

In an offshore drilling facility, apparatus is disclosed comprising: a drilling floor centralizer for receiving the upper end of a string of drilling riser sections; a moon pool centralizer for receiving another portion of the drilling riser; and at least one roto-track, removably and rotationally carried by at least one of the pin end of one drilling riser section and the box end of the adjacent drilling riser section, for extending the outer diameter of each of the adjacent ends to the outer diameter of the adjacent drilling risers sections intermediate the ends of the drilling riser sections.

26 Claims, 17 Drawing Sheets

(56) References Cited

U.S. PATENT DOCUMENTS

| | | | | |
|---|---|---|---|---|
| 5,641,248 | A | 6/1997 | Arlt, III | |
| 5,950,737 | A | 9/1999 | Chou et al. | |
| 6,367,846 | B1 * | 4/2002 | Aaron, III | 285/123.15 |
| 6,988,459 | B2 * | 1/2006 | Roodenburg et al. | 114/268 |
| 7,013,824 | B2 | 3/2006 | Otten et al. | |
| 7,017,666 | B1 * | 3/2006 | Allen et al. | 166/367 |
| 2004/0134661 | A1 * | 7/2004 | von der Ohe | 166/367 |
| 2005/0147473 | A1 * | 7/2005 | Pallini et al. | 405/224.4 |
| 2008/0031692 | A1 * | 2/2008 | Wybro et al. | 405/224.4 |
| 2008/0289829 | A1 * | 11/2008 | Bergeron et al. | 166/350 |

OTHER PUBLICATIONS

Bernard, et al., "New Generation Deepwater Risers A Design Methodology", DP MTS Symposium, Sep. 28-30, 2004, Houston, Texas.

* cited by examiner

RISER CENTRALIZER SYSTEM (RCS)

CROSS-REFERENCE TO RELATED APPLICATIONS

The application is a utility conversion of U.S. provisional patent application filed on Sep. 9, 2008 under Ser. No. 61/095,338, which claims priority to this foregoing provisional application.

TECHNICAL FIELD

This invention relates to the general subject of oil and gas production methods and equipment and, in particular to subsea production processes and apparatus.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

Deepwater oil and gas exploration and production projects face many unique challenges that impact associated production facilities and drilling activities. Hurricanes and loop currents rank high on the list of factors that hinder deepwater operations. Hurricane and loop currents shorten the operability envelopes for drilling activity, and shutdown operations. They also can cause system failure.

Moored facilities have operability limitations compared to those that are dynamically positioned (DP):

- Unable to drift with current or weather-vane to aid running/retrieving drilling riser in presence of underwater currents
- Interference with diverter housing prevents running/retrieving drilling riser even in relatively low underwater currents
- Unable to move away from a storm
- Preparation time for storms is much longer
- Running/retrieving operations on a moored drilling vessel may not be possible with currents exceeding about 1.0 knot
- Big problem during hurricane season when weather can deteriorate rapidly
- Deploying drilling riser in a region where loop currents can occur in combination with hurricanes presents a potential risk to the platform Referring to FIG. 1, BP America's ThunderHorse facility is depicted. ThunderHorse a semi-submersible 50 having a derrick 52, and a main or drilling floor or deck 54. Additional details are shown in FIG. 2.

Sitting in 6,000 ft (1,829 m) of water about 150 ml (241 km) offshore, the ThunderHorse production-drilling-quarters (PDQ) semisubmersible is the largest production semi ever built, with a total displacement of 130,000 tons (117,934 metric tons). The topsides area of ThunderHorse is the size of about three football fields, and is packed with equipment and systems to treat and export 250,000 b/d of oil plus associated gas.

Harnessing ThunderHorse posed challenges in almost every aspect of development. Everything is interrelated and, as a result, you can't do anything in isolation. A very well defined and coordinated approach involving every aspect of a task is required. Even small issues can quickly magnify because of the compounding effect.

ThunderHorse is located in ultra deep waters with both loop currents and the threat of hurricanes. The project must also contend with reservoir temperatures up to 270° F. (132° C.), pressures up to 18,000 psi (124 MPa), and a reservoir with flow rates of up to 50,000 b/d of oil/well. As a result, ThunderHorse required larger bore tubing inside the wells than is normally used in the Gulf of Mexico and a very large, long and heavy riser assembly.

There are three basic operating modes for drilling risers:

1. Connected
2. Fully Retrieved
3. Hung-off

In the event of excess underwater currents, operators often want the drilling riser/LMRP (Lower Marine Riser Package) either fully retrieved or connected. If a hurricane is expected, operators usually want drilling riser/LMRP fully retrieved or hung off. Depending on magnitude of storm, in a connected mode, the upper flexible joint might exceed operational limits. If the riser is hung-off in loop currents, fatigue life is dramatically reduced. Nevertheless, it is often preferable to remaining connected during a hurricane.

Stopping all work and retrieving the riser, while conservative and safe, is clearly a high cost option. It also requires a large amount of deck space which leads to a larger and more expensive facility. There is also the risk of equipment damage during the retrieval and the possibility of dropped objects.

Disconnecting the riser and using a parking pile is another possibility. However, riser fairings may be needed and riser tensioners may have to be modified to allow the riser to stroke.

This problem has existed for some time. Considerable effort has been made, and significant amounts of money have been expended, to resolve this problem. In spite of this, the problem still exists. Actually, the problem has become aggravated with the passage of time because more facilities are drilling in deeper and deeper parts of the world and hurricanes have been increasing with greater force and frequency.

SUMMARY OF THE INVENTION

The invention is applicable to an offshore drilling facility having a drilling deck or floor, having a moon pool deck or floor located below the drilling floor, and having a string of at least two drilling riser sections that are connected end to end and that extend through the moon pool. Each basic drilling riser section has a box end, an opposite pin end, and an outer diameter intermediate its ends that is less than the outer diameter of each of the ends.

In one embodiment of the invention (See FIGS. 1, 2 and 3), a riser centralizer system (RCS) is provided comprising:

a drilling floor centralizer (DFC), carried by the drilling floor (See FIGS. 8 and 9), for receiving and centralizing the upper end of the string of drilling riser sections;

a moon pool centralizer (MPC), carried by the moon pool floor (See FIGS. 6 and 7), for receiving and centralizing at least a portion of the string of drilling riser sections; and at least one roto-track (See FIGS. 12 and 13), removably and rotationally carried by the pin end of one drilling riser section and the box end of the adjacent drilling riser section, for extending the outer diameter of each of the adjacent ends to the outer diameter of the adjacent drilling riser sections intermediate the ends of those drilling riser sections.

In one embodiment, each centralizer comprises a set of rollers that allow facility personnel to mechanically center the drilling riser in the diverter housing to enable its recovery. Preferably, the MPC has the capability to:

release even at slight riser angles, capture at angles other than vertical, and exert force on the drilling riser in order to position the riser for retrieval.

The DFC offsets the movement and force generated by the MPC which assists in centering the riser for retrieval, and reducing damage to the drilling riser and the facility from the adjustments the MPC makes to riser alignment.

In addition to the centralizers, one embodiment of RCS includes modifications to the riser's joints which aid in the retrieval of the riser. Slick joint tracks accommodate the centralizer rollers, and the roto-tracks on each joint bridge the gaps between joints. The flexible design of the RCS allows its implementation in various drilling structures found in deepwater, making it a viable option in new as well as old projects.

By augmenting a given retrieval threshold, the RCS helps increase the number of drilling days during the hurricane season which should result in increased production. Although not tested at the time of filing this patent application, the RCS should:

reduce the running and retrieval time of the drilling riser, decrease the time the drilling riser is exposed to the severe ocean environments, lower the risk of damage as well as operational risks associated with dropped objects, and enhance the overall safety of the vessel's crew.

The RCS should also reduce risk of potential damage to drilling riser and other subsea infrastructure by reducing the probability of the riser remaining connected during a hurricane.

In addition, the RCS should enable a drilling riser to be secured in a hang-off mode (or potentially fully retrieved) in up to about 3 knots of current (instead of about a 1 knot of current without the RCS). This should lead to:

reduced risk of damage to the upper flex joint, drilling riser and subsea equipment, and expanding the drilling vessel's operational envelope.

Numerous other advantages and features of the present invention will become readily apparent from the following detailed description of the invention, the embodiments described therein, from the claims, and from the accompanying drawings.

DETAILED DESCRIPTION

Figure 1:
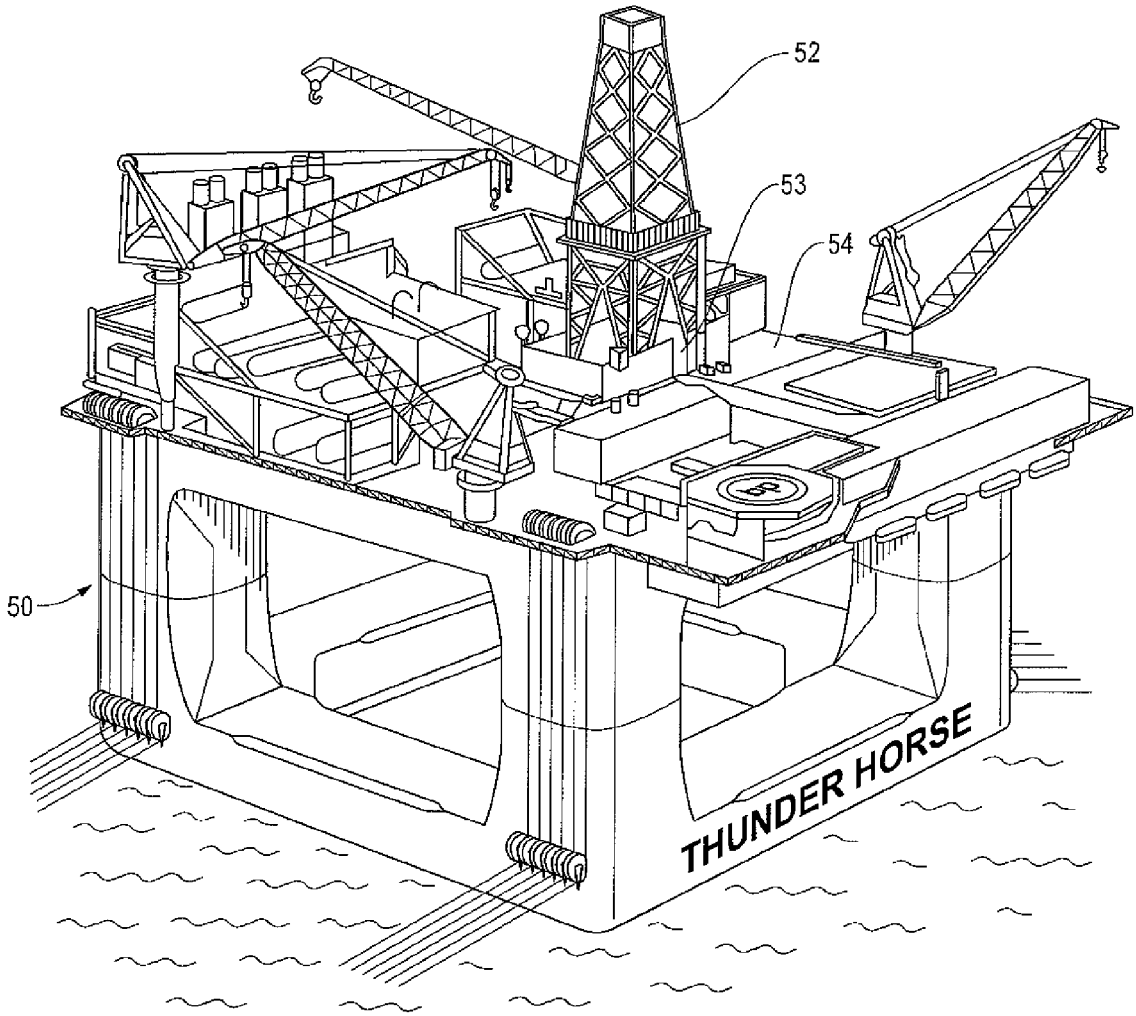
FIG. 1 is a pictorial representation of a semi-submersible drilling facility for which one embodiment of the present invention was designed.

While this invention is susceptible of embodiment in many different forms, there is shown in the drawings, and will herein be described in detail, several specific embodiments of the invention. It should be understood, however, that the present disclosure is to be considered an exemplification of the principles of the invention and is not intended to limit the invention to any specific embodiment so described.

The invention comprises the following concepts:

A. RISER ROTO-TRACKS;

B. MPC POWERED GIMBAL ON CAGE;

C. MPC RACK LOCKS;

D. MPC MOUNTED ON TRACKS BY MOON POOL;

E. MPC WITH EXTENDED REACH;

F. MPC WITH ROCKER STYLE ROLLERS;

G. MPC CAGE WITH REPLACEABLE ROLLERS;

H. MPC LOAD CELL MECHANISM;

I. MPC QUADRANT CAMERAS TO CENTRALIZE TENSION RING;

J. DFC WITH STEP OVER SUPPORT FLANGE AND RETRIEVAL JOINT;

K. DFC LOAD CELL MECHANISM; and

L. EMERGENCY HANGOFF.

Figure 2:
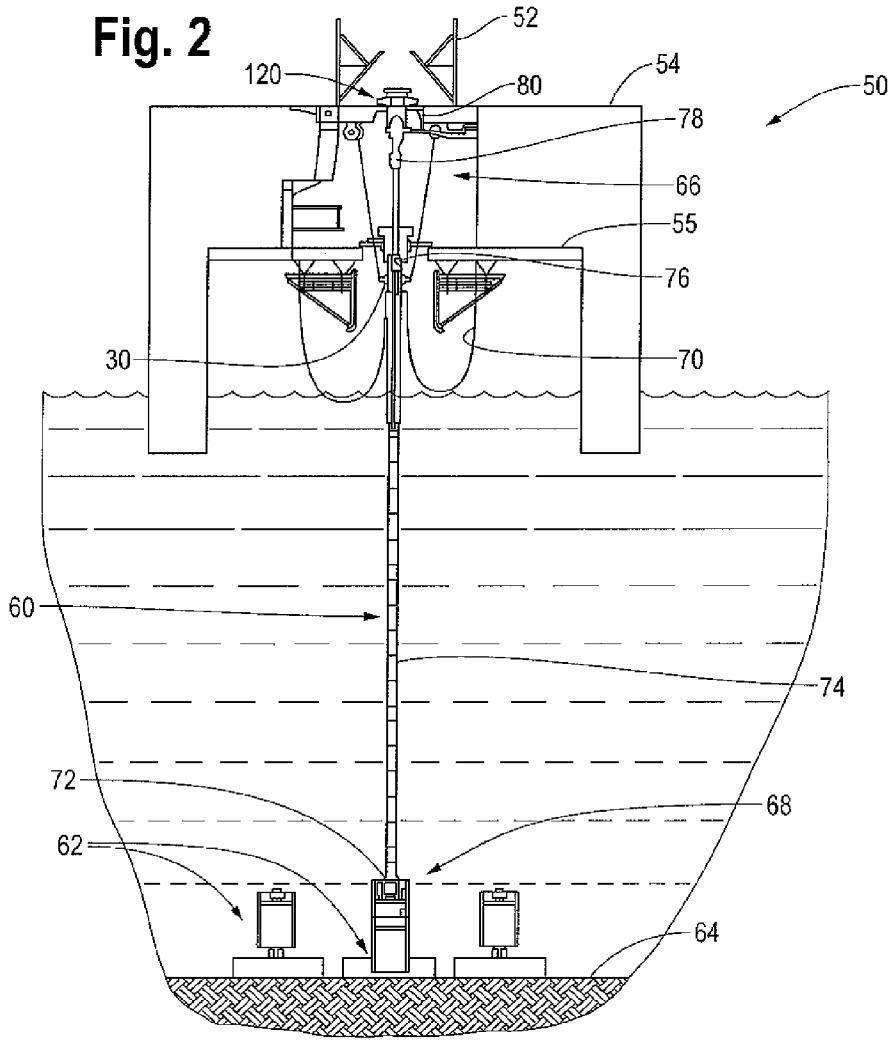
FIG. 2 is a cross section of a semi-submersible vessel of FIG. 1 showing the drilling riser going down to the blowout preventer stack on the seafloor.

Before providing a description of these features the overall arrangement of the riser components will be described:

Referring to FIG. 2, marine drilling risers 60 are used to provide a return fluid-flow path between the well bore and the drill vessel 50 and guide the drill string to the wellhead 62 on the ocean floor 64. The marine riser must withstand the lateral forces of the waves, currents and vessel displacement. It must also withstand the axial loads imposed on by the buoyancy weight of the drilling mud, drill pipe, and the marine riser itself. With a tensioned riser system 66, the riser must withstand the axial tension imposed from the surface. Subsea choke and kill line connections are manifolded and arranged to permit pressure release, or the pumping in of mud through either connection. These lines are run down the outside of the marine drilling riser in a hard steel pipe with flexible couplings providing the means of attachment to the BOP stack 68. The choke and kill line connections to the vessel are by means of flexible hoses 70 suitably dimensioned to absorb wave induced motion.

The marine-riser system, includes (from bottom to top):

the marine-riser connector 72 (i.e., LMRP);

individual riser joints 74 with their connectors;

a telescope joint 76, and flexible joint 78 between telescope joint and the top riser joint.

Flexible joints 78 are used in the marine-riser systems to minimize the bending moments and stress concentrations. In deep water operation and in severe sea conditions, a flexible joint is provided just above the telescopic joint. It helps stress concentrations created by wave forces in this zone and by the change in section between the telescopic joint and the top marine riser joint. The design of the flexible joint provides:

adequate angle of flexure for the total floating-drilling system designed;

sufficient strength for the tension applied; and rotation with low resistance while under the anticipated tension load.

The telescopic joint 76 serves as a connection between the marine riser 60 and the drilling vessel or facility 50, compensating for the vertical movement of the vessel. In operation, an upper member (or inner barrel) is connected and moves with the drilling vessel (via a Tension Ring 30 see FIG. 2). The lower member (or outer barrel) is an integral part of the marine riser and remains stationary relative to the ocean floor. Support brackets are mounted on the lower member for the riser-tensioning system and for the kill and choke-line connections. The upper member is usually fabricated with a bell nipple as a part of the joint. Tie bars and locking clamps are installed to hold the joint in a collapsed position to facilitate the handling and installation of the unit. When installed, the tie bars act as the support members for the upper sliding member and are connected to the drilling vessel.

A diverter 80 provides a means of diverting an unexpected release of well fluids from the riser, primarily gas and occasionally solids, to a location at the extremities of the rig where they can be discharged safely. The diverter is situated on top of the riser stack and must permit the passage of the drilling string. During normal drilling operations, the diverter vents are closed and the drilling mud returns flow upwards and into the bell housing, and then into a shale shaker. Operating the diverter results in the closure of a packing element around the drilling string and opening of the vents, allowing an unrestricted passage for well fluids to the atmosphere.

A. Riser Roto-Tracks

Figure 9A:
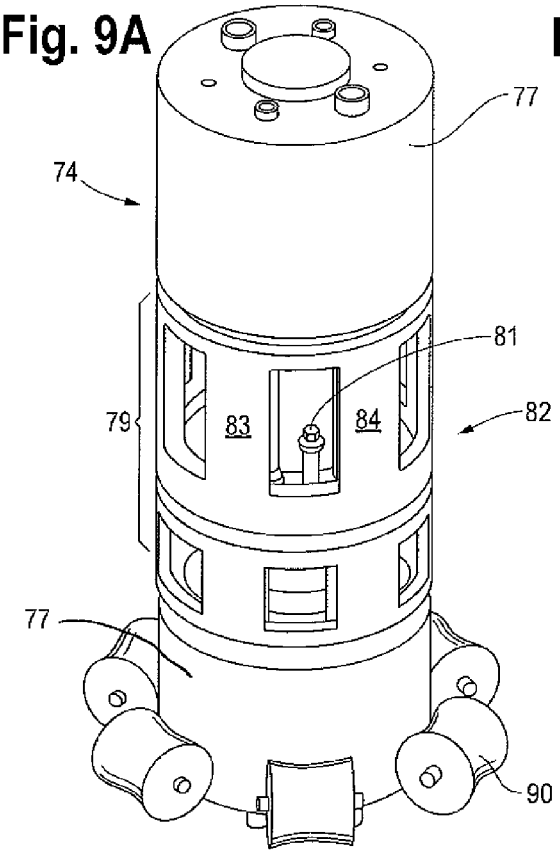
FIG. 9A is a pictorial view of the Roto-Tracks on the drilling riser oriented to allow access to the drilling riser flange bolts and for engagement of the drilling riser spider support dogs.
Figure 9B:
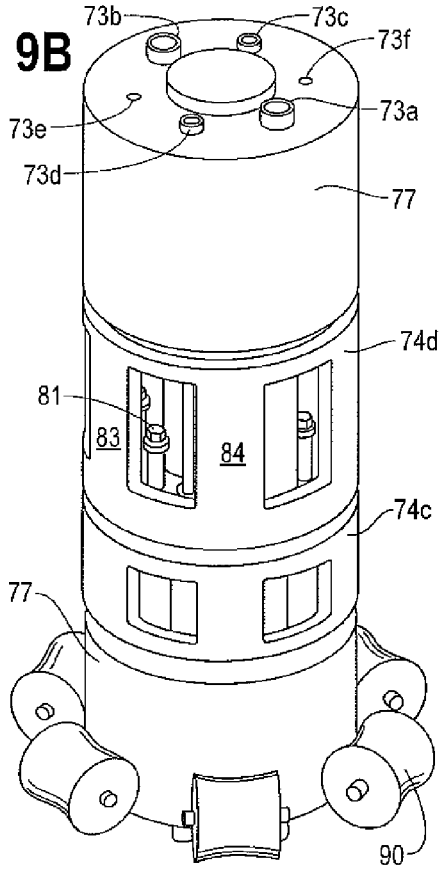
FIG. 9B is a pictorial view of the Roto-Tracks on the drilling riser oriented to provide the necessary track area for roller guidance of the drilling riser.
Figure 10A:
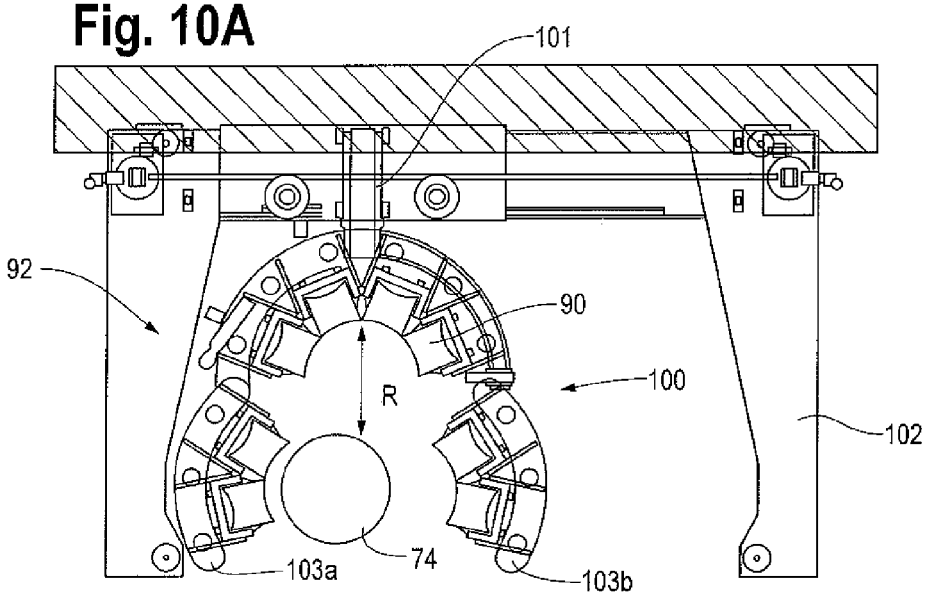
FIG. 10A is a top view of the MPC in its open position.
Figure 10B:
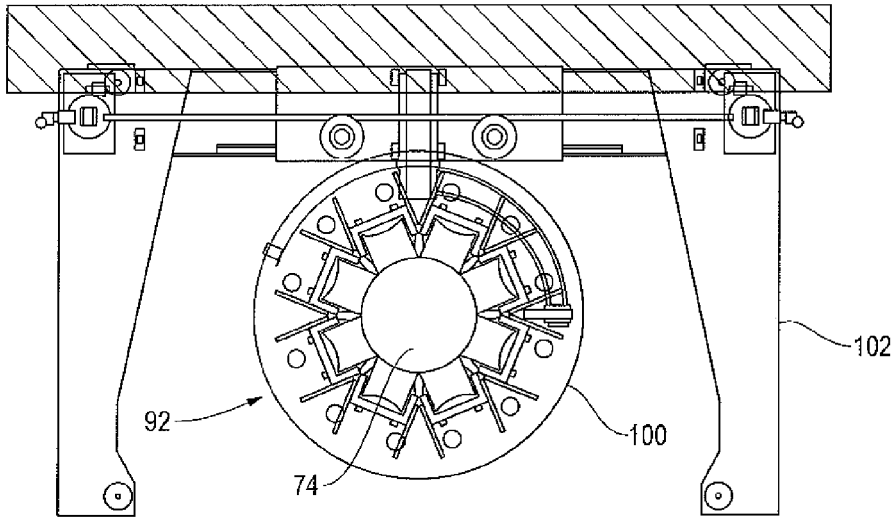
FIG. 10B is a top view of the MPC in its closed position.
Figure 11:
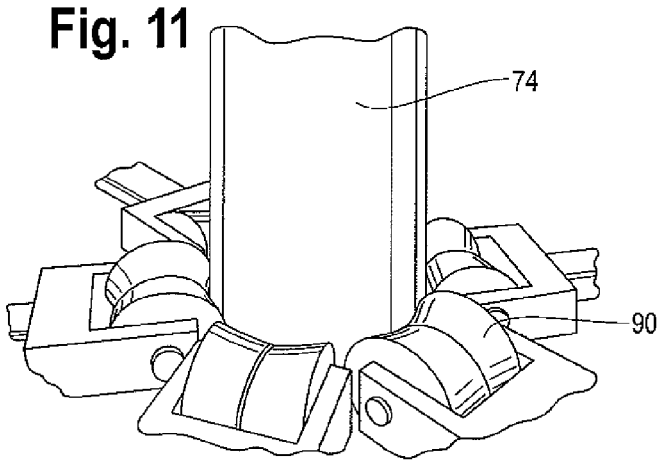
FIG. 11 is a perspective view of the DFC rollers engaging the drilling riser.
Figure 18:
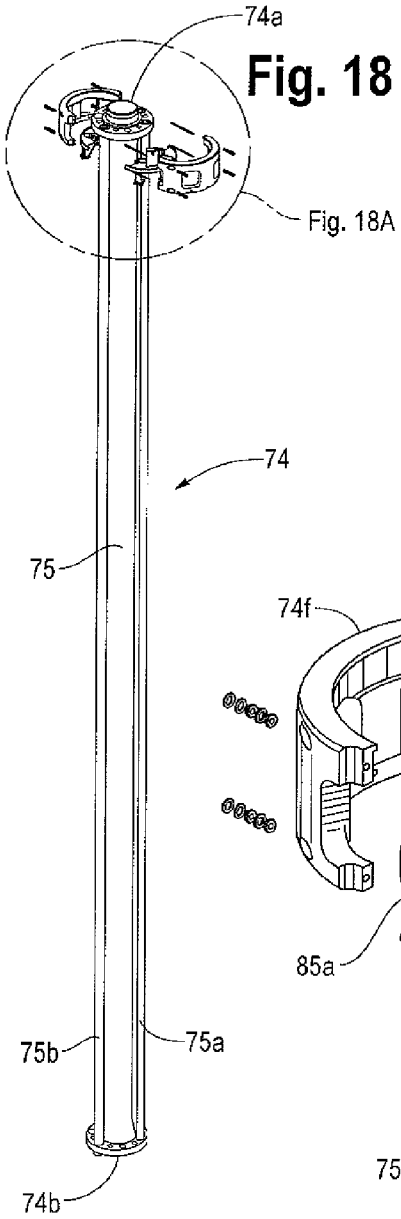
FIG. 18 shows a pictorial view of a joint of drilling riser with the Roto-Track being installed on the upper or pin end.

As shown in the drawings, the drilling riser 60 comprises a series of drilling riser sections or joints 74 removably joined end to end (See FIG. 2). Each riser section (See FIGS. 18 and 18A) has two opposite ends, a pin end 74*a* and box end 74*b*. Between the ends, there is a large centrally located conduit 75 (through which the drillstring is inserted) and a plurality of small diameter fluid lines (e.g., for the kill 73*a* and choke lines 73*b* of the associated Blowout Preventer (BOP)) which surround the central conduit. Other fluid conduit and instrumentation lines (i.e., service lines 73*c*, 73*d*, 73*e* and 73*f*) are located around the central conduit of the riser section 74 (See FIG. 9B). More importantly, each drilling riser section 74 is conventionally characterized by a non-uniform outer diameter from one end to the other. The bare riser section is often referred to as a "slick joint". Very often, floatation foam (e.g., "Syntactic Foam") 77 is located intermediate the ends of the riser section to add buoyancy. Preferably, the drilling riser 60 is negatively buoyant overall to avoid the danger of the riser striking the rig should it brake loose of the BOP. That negative buoyancy is overcome by the upward support provided by the outer barrel of the telescopic joint.

In one specific embodiment designed for BP America's ThunderHorse facility, there is a gap 79 (See FIGS. 9A and 9B) of approximately 6 feet between the 52.25" diameter flotation foam of one riser joint to the next riser joint. Because the ultimate exterior load must be spread on the flotation foam 77 while bridging that gap, conventional supports are unacceptable.

In accordance with the present invention, "Roto-tracks" 82 are used to bridge over this long gap to make it practical for guidance and support rollers (on the MPC and DFC) to run over this gap. In the ThunderHorse situation depicted in the drawings, there are six paths along the ends of each drilling riser section (See top of FIG. 18A). This is primarily defined by the personality of the telescopic joint 76 at the top of the drilling riser string. Gooseneck connections (to connect the choke, kill, and service lines (See FIG. 2 at 70)) prevent full circle support. As such, the exterior areas (e.g. 83, 84, of FIGS. 9A and 9B.) available for support are midway between the choke, kill, and service lines. At the rig floor, supporting spider dogs must engage midway between the choke, kill and service lines. Additionally, make-up bolts 81 and operating hydraulic wrenches must be inserted between the choke, kill, and service lines. This means that the tracks 82 are located where most riser assembly activities occur.

Figure 18A:
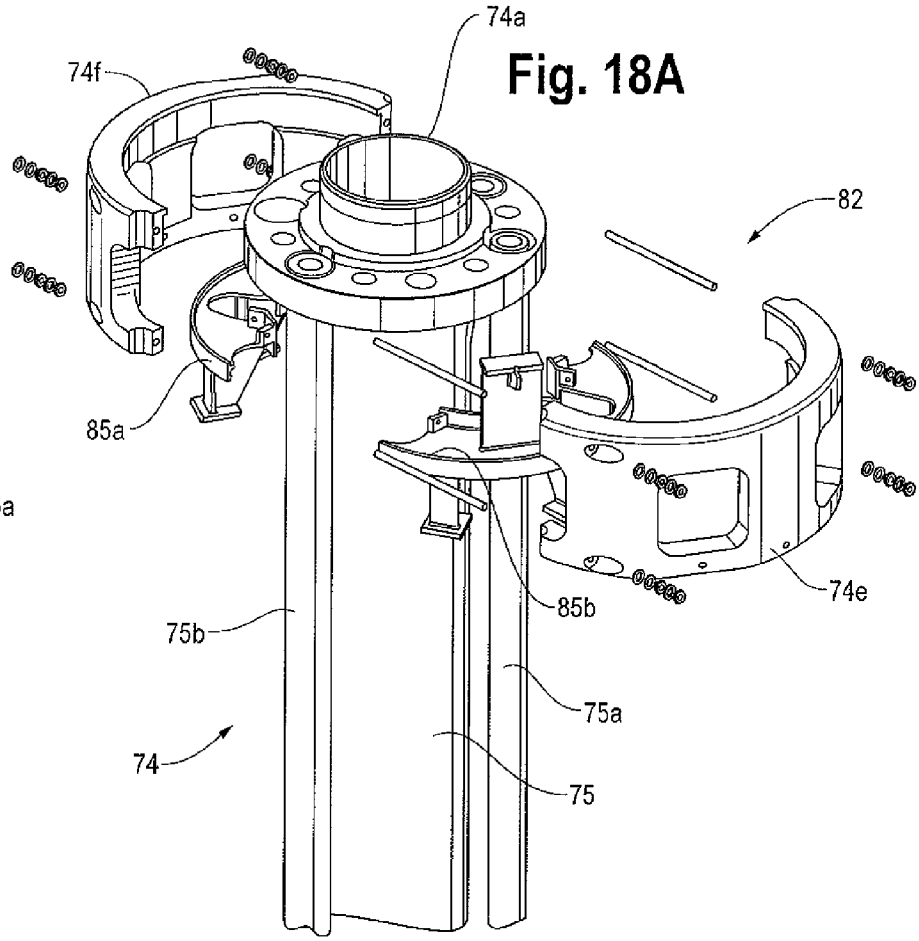
FIG. 18A shows an enlarged view of the upper end of FIG. 18.

Referring to FIGS. 4B, 8, 9A, 9B, 18 and especially FIG. 18A, the Roto-tracks comprise a plurality of relatively smooth, generally elongated "tracks" (e.g., 82*a* and 82*b*) comprising six sections that are centered about 60 degrees apart. They are rotatably and irremovably installed on a mounting ring 85 which fits around each of the ends 74*a* and 74*b* of each riser section 74. During make-up on the rig floor, the tracks are rotated to a "first position" opening between the tracks allows access to the support areas and the bolting areas (see FIG. 9A). After make-up and when the drilling riser flange is lifted up off the spider supports, the Roto-Tracks 82 are rotated 60 degrees to a position (see FIG. 9B) providing an essentially un-interrupted supporting surface from one riser section to next. As shown in the drawings, the Roto-Tracks are made in:

- a shorter pin style 74*c* which mount on the upper or pin 74*a* end of a drilling riser joint, and
- a longer box style 74*d* to mount on the lower or box end 74*b* of the drilling riser joint.

Figure 4:
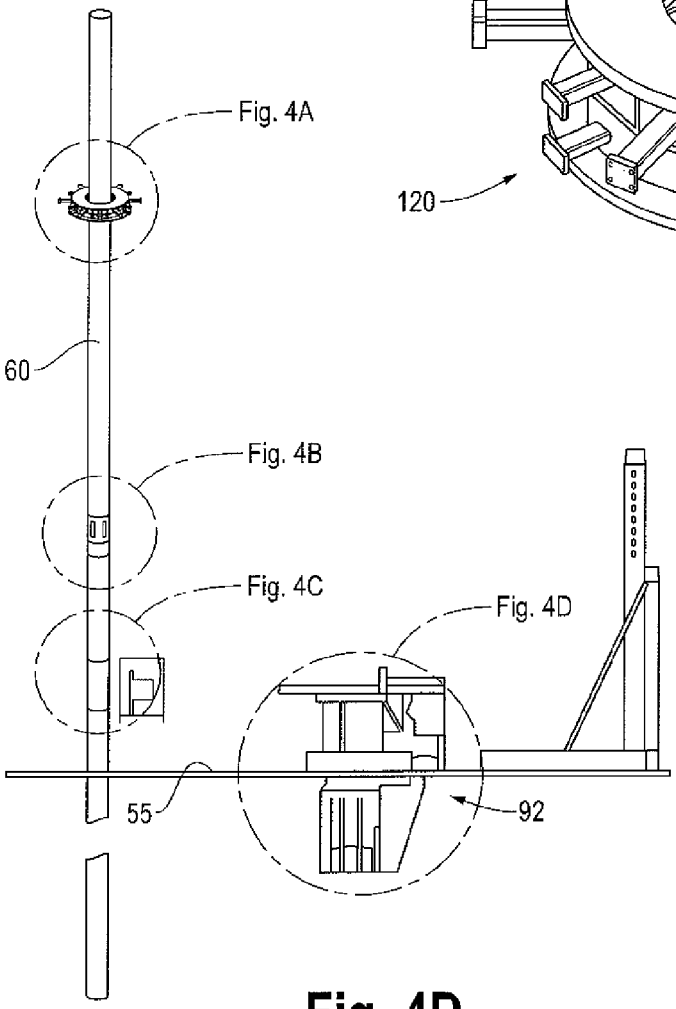
FIG. 4 shows a pictorial view of the major components of the present invention.
Figure 4A:
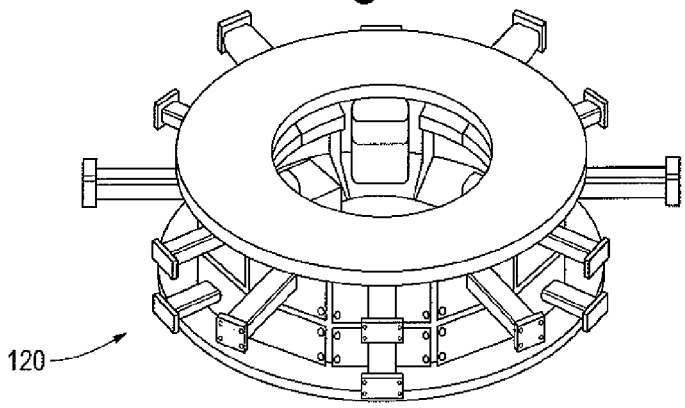
FIG. 4A shows a pictorial view of the Drilling Floor Centralizer.
Figure 4B:
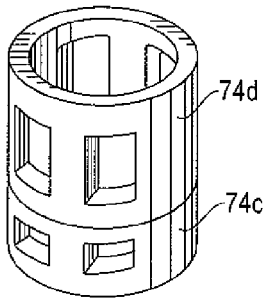
FIG. 4B shows a pictorial view of the Roto-Tracks.
Figure 4C:
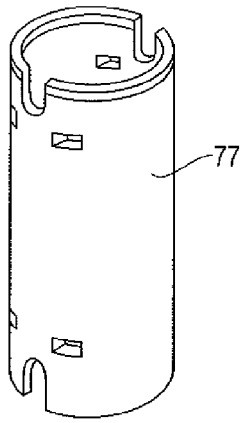
FIG. 4C shows a pictorial view of the two halves of the syntactic foam buoyancy modules put together.
Figure 4D:
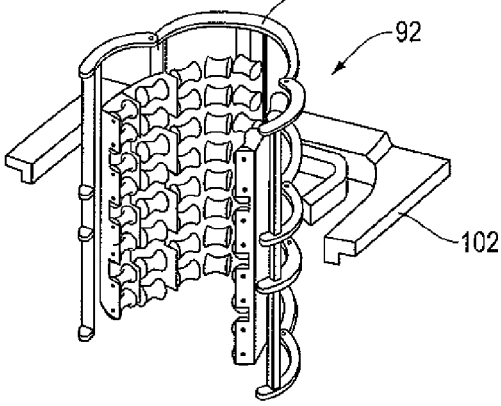
FIG. 4D shows a pictorial view of the Moon pool Centralizer with the doors open as if engaging with or disengaging from the drilling riser.
Figure 5:
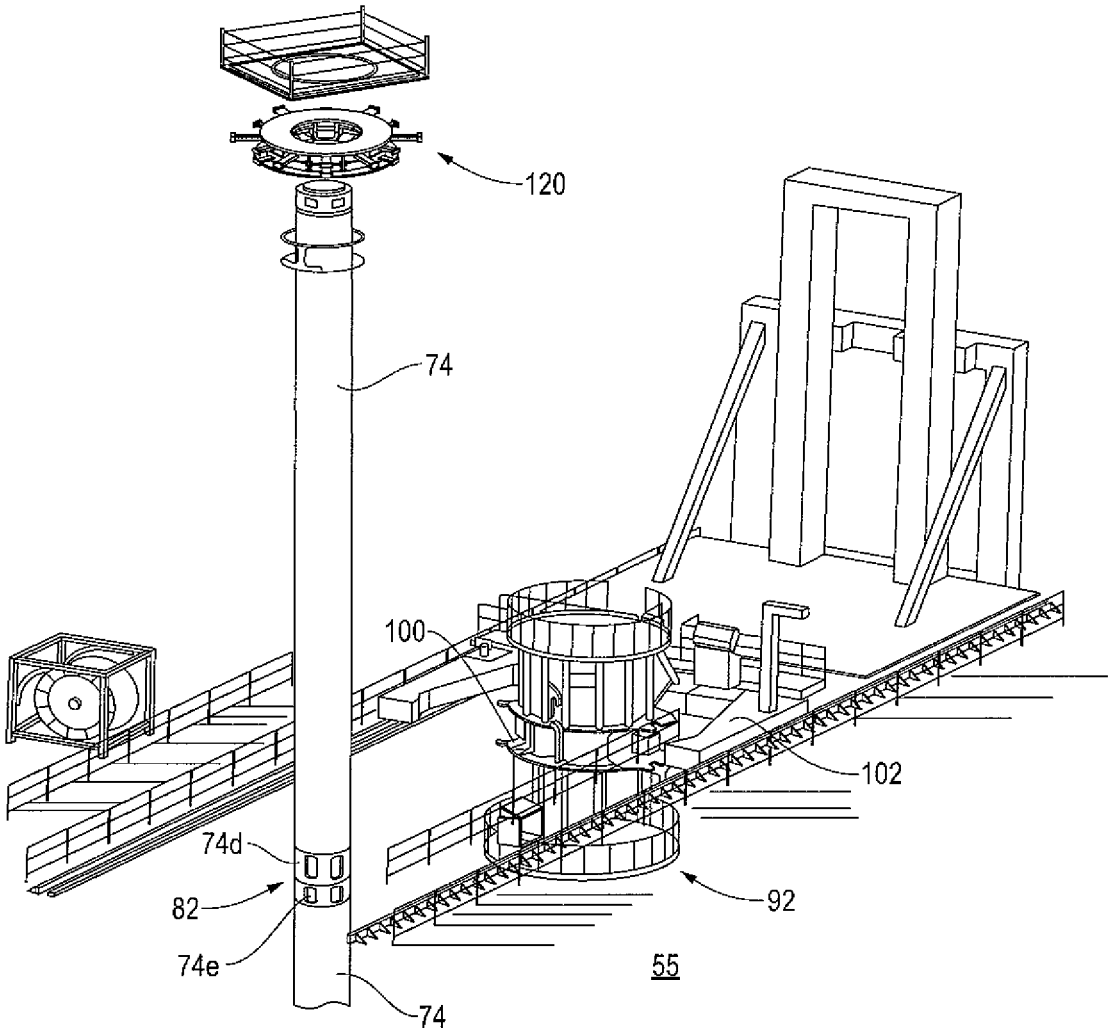
FIG. 5 is a perspective view of the major components of the present invention, relative to the level of the moon pool.

FIG. 18A illustrates one way of attaching the Roto-Tracks, wherein each Roto-track compress two half cylinders 74*e* and 74*f* made of flotation foam which are bolted onto an underlying metal mounting ring 85*a* and 85*b*. In the event that a slick joint is not provided with flotation foam (i.e., to reduce positive buoyancy overall), the joint is provided with a cowling, shell, or jacket ("slick joint track") 77 (See FIG. 4C) to provide a generally uniform, relatively smooth outer diameter intermediate the ends of the riser section when combined with the Roto-tracks, the floatation foam and/or slick joint tracks.

B. MPC Powered Gimbal on Cage

Guidance of the drilling riser in the vicinity of the moon pool is provided by a Moon pool Centralizer (MPC) 92. In BP America's ThunderHorse facility, in order to engage the drilling riser 60 (which could move an excursion of 5 feet from center at 50 degrees at the moon pool level), the MPC 92 must move 5 feet; it also needs to match the 50 degrees maximum angle of the drilling riser. Referring to FIGS. 5, 7, 10A and 10B, the MPC comprises of Cage Portion 100, a Yoke 101 and a Moveable Base 102. The Cage Portion 100 of the Moon Pool Centralizer is fully pivoted at its attachment to the Moon Pool Centralizer Base. This gives it a pivot point in the fore/aft plane.

This attachment is in the form of a Yoke 101 (see FIGS. 15, 15A through 15*c*), with the two opposite ends of the Yoke connecting directly to the Cage 100 with a pivots 101*a* and 101*b*. This pivot gives port/starboard freedom, and the combination of pivots allows the Cage 100 to fully gimbal in any direction. The Base 102 is carried by and attached to the Moon pool deck 55. The Base member allows the MPC to move clear of the moon pool. The Cage 100 is provided with two hydraulically powered doors 103*a* and 103*b* by which the riser 60 enters the MPC. In particular, the doors comprise two cage segments 103*a* and 103*b* which are hung from the main body of the Cage 100 which is otherwise held by the Yoke 101. Each cage segment is opened and closed by means of hydraulic cylinders or motors 104.

Rotational motions in both the fore/aft and the port/starboard directions are provided by a hydraulic cylinders tied to Yoke, such that the unit can be powered to match the angle of the drilling riser prior to engagement. After the Moon Pool Centralizer engages the drilling riser 60, the doors 103*a* and 103*b* are closed and lock. Preferably, the locking of the doors automatically releases the pressure on the pivoting cylinders, allowing the angle of the MPC Cage 100 to be determined by the angle of the drilling riser.

C. MPC Rack Locks

In one embodiment, port/starboard and fore/aft movements of the Moon Pool Centralizer are achieved by gears within the Base 102 running along gear racks 105 fixed to the moon pool deck 55. The motors driving the gears have internal fail safe brakes. One specific advantage is that if a seal fails in the motor (or in alternatively used hydraulic cylinders), there is no release of energy. Preferably, the hydraulic motor and gear are removable under load to increase the overall reliability of the system. Because the motor can fail at any location along the rack, which has a repeating tooth profile of (2.47", in one embodiment), it is not adequate to simply engage the rack; it must be engaged at the right at location along the 2.47" profile.

In accordance with the present invention, a Lock Dog (kept in a pocket by a Spring Dog), and a Shifting Rod (extending from the Lock Dog towards the gear rack teeth) are provided. When the Lock Dog is moved forward by a hydraulic cylinder at its rear, the Shifting Rod is depressed against a spring until it "pops" into a tooth profile. Further forward movement by the Lock Dog causes it to slide along the Shifting Rod which shifts the Lock Dog into specific engagement with the rack gear profile.

Once shifted and fully engaging the rack gear profile, Lock Screws are engaged against the mating faces on the Lock Dog, and the MPC is locked exactly where it is.

D. MPC Mounted on Tracks by Moon Pool

Referring to FIGS. 7 and 10A, 10B, 12 and 12A, the present invention uses a roller track system to provide full mobility to the MPC system and substantially increase the control and capacity of the system.

In particular, the Cage 100 portion of the Moon Pool Centralizer comprises a plurality of rollers 90 that have a generally horizontal axis, that are disposed around the periphery of the riser 74 passing there-though, and that are stacked vertically to at least extend beyond the gap 79 between two adjacent riser sections. In particular, and referring to FIG. 7, the Cage portion is used to mount the rollers. Together with the Yoke 101, they accommodate rotation about the roll and pitch axes of the vessel 50.

The MPC Cage 100 is configured to surround the riser section 74 with a plurality of rollers 90 distributed vertically and circumferentially allowed the riser. Each roller composes a relatively soft exterior (e.g., polyurethane). Looking at the drawings, each roller is generally in the shape of "apple core". Referring to FIG. 12B, a cross-section is taken through the centerline of a roller. Three circles are shown. Looking at the upper-most roller 91, the middle circle illustrates the outer diameter of the polyurethane plastic which is molded on the roller. The inner circle depicts the interface between the polyurethane and the steel part of the roller. The axle 91*a* of the roller is at its center. The outer circle is the larger O.D. at the ends of the roller, partially hidden behind the riser flotation foam 77.

E. MPC with Extended Reach

Those skilled in the art appreciate that deck space in the vicinity of the moon pool is always in short supply. By providing two hydraulically powered cage doors, 103*a* and 103*b*, the "reach" R of the MPC can be extended without otherwise limiting the movement of the drilling riser. (See FIG. 10A). In particular, and in the case of BP America's ThunderHorse facility, the structure of the Moon Pool Centralizer allows for its movement forward and aft a distance of 4 feet. The anticipated movement of the drilling riser at the level of the Moon Pool Centralizer about is 5 feet, or one foot more than the Moon Pool Centralizer can move.

In particular, the Moon Pool Centralizer gains an extra foot of reach capacity by:

Providing a set of doors 103*a* and 103*b* (which together comprise about one half of the Cage) to forwardly engage the exterior of the drilling riser; and Moving the riser into a captured position within the Cage 100.

F. MPC with Rocker Style Rollers

If the MPC rollers 90 were mounted rigidly on a Cage 100 (See FIGS. 3, 3A, 3B and 3C), the resiliency of the relatively soft roller exterior would be used to spread out the load uniformly. However, high forces could cause bending of the drilling riser 60 passing therethrough which could exceed the ability of the resilient coating are the rollers to compensate.

Figure 12:
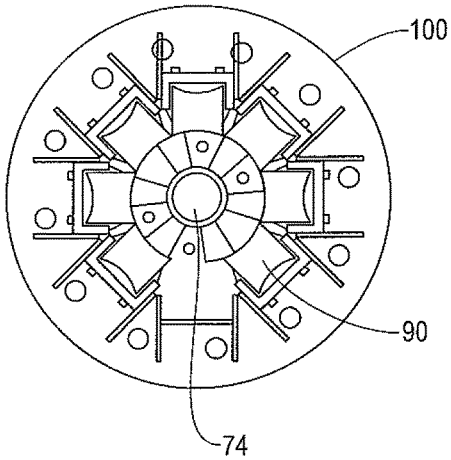
FIG. 12 is a top view of the Moon pool Centralizer rollers engaging the drilling riser.
Figure 12B:
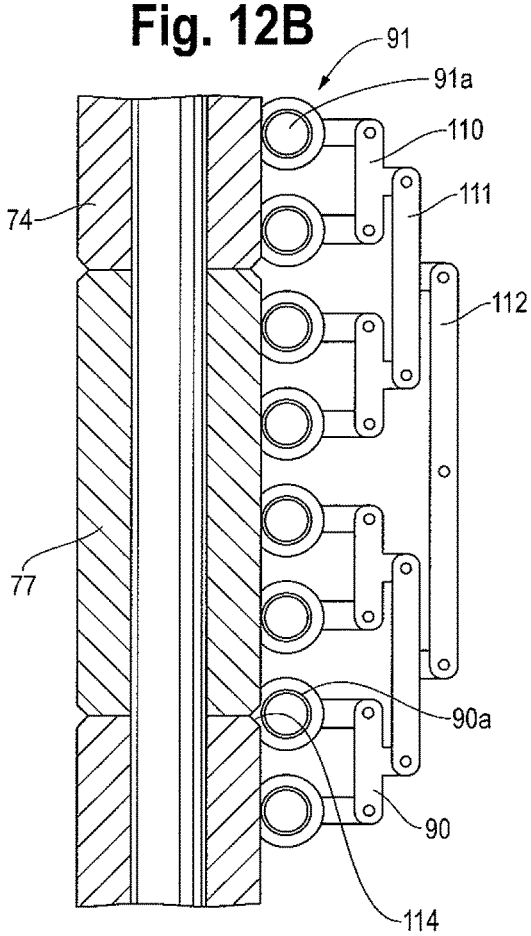
FIG. 12B is a schematic of the mounting arrangement of the rollers in the Moon pool Centralizer showing how the loads are uniformly distributed along the drilling riser.
Figure 12A:
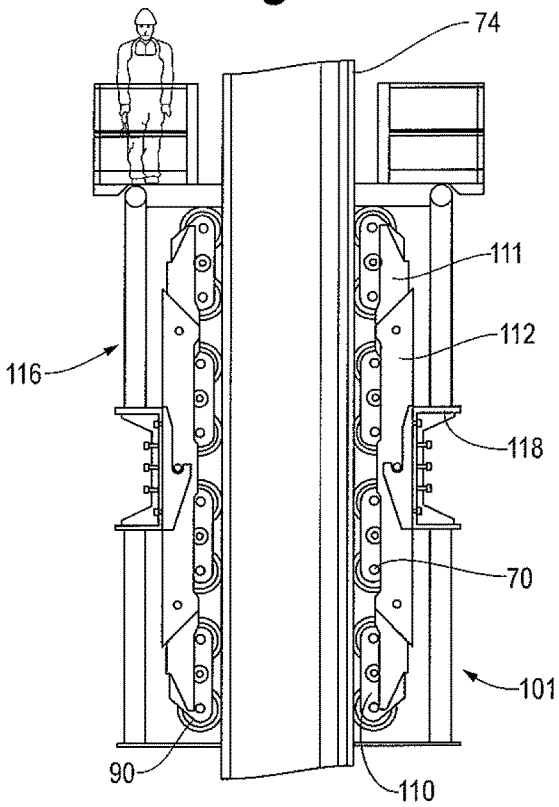
FIG. 12A is a cross-section of view 12, taken through the centerline of a roller.
Figure 13A:
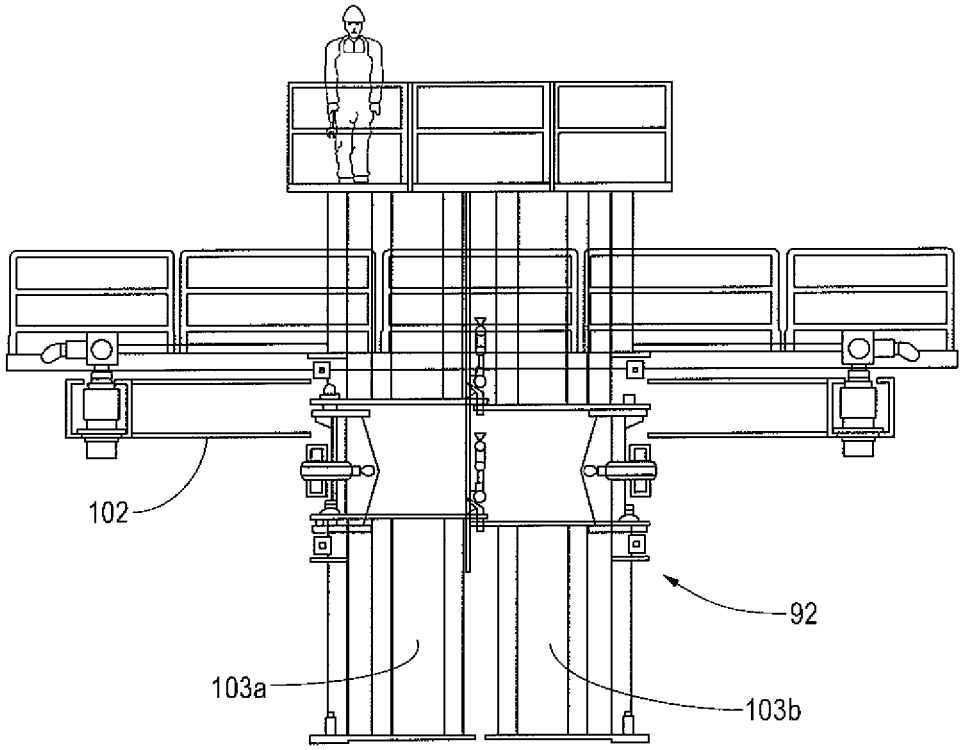
FIG. 13A is a front view of the Moon pool Centralizer.
Figure 13B:
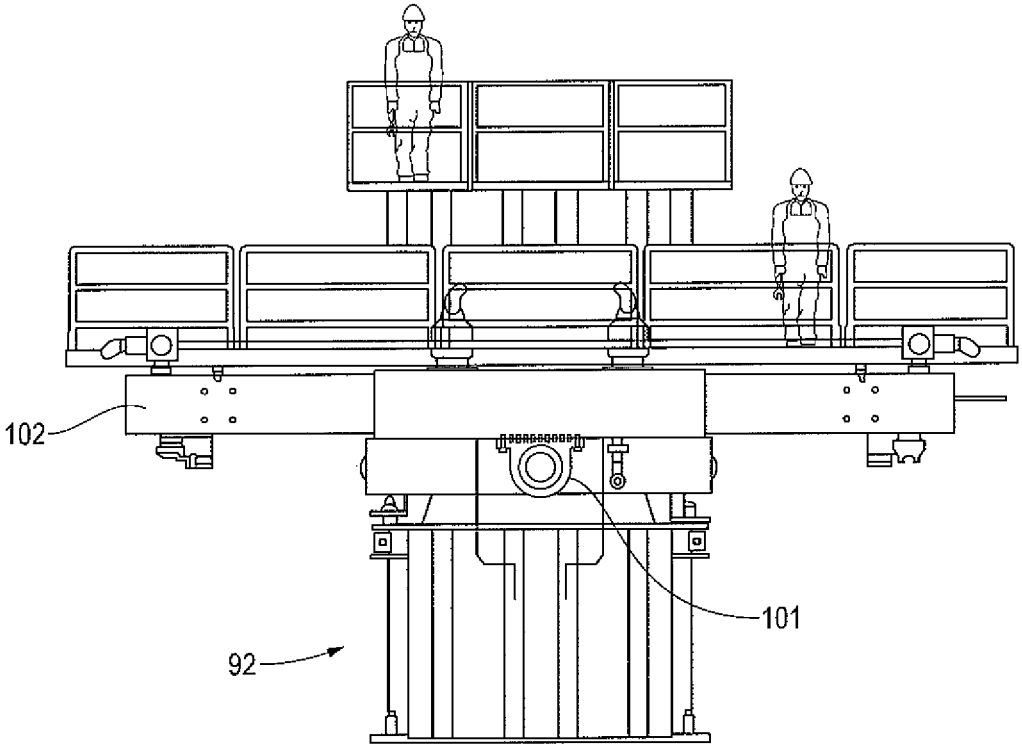
FIG. 13B is a rear view of the Moon pool Centralizer.

FIGS. 12, 12A, and 12B show a unique method of dividing the load between adjacent rollers 90 by using a plurality of rocker arms or "rockers". Two small rockers 110 divide the load to a middle size rocker 111, and then the two middle size rockers divide the load to a large rocker 112. By this innovation, the load can be more uniformly distributed between all of the surrounding eight rollers to minimize the maximum stress on the flotation foam and the drilling riser.

Secondly, when a roller 90*a* goes over a gap 114 or a groove, such as is between sections of flotation material 77 of the riser sections 74, there is a tendency for the roller to fall into that gap or groove, especially when tolerances have accumulated and the gap is larger than desired. In the ThunderHorse situation, there is actually a ¼" gap, and this means that, without more, a roller would move ¼" into that gap. Adding a washer at each of the ends of the axle roller, avoids this tendency. The benefit of this inventive feature is that the washer prevents the roller from falling a long way into a gap and it makes it easier for the roller to recover on the opposite side of the gap. This is especially important when the drilling riser is being pulled at high speed (e.g., up to 350 feet/minute.) Those skilled in art should be aware that, in some situations, the load on the floatation foam can almost double. The doubled load is typically directly over a hard support area of the foam rather than on stress sensitive cantilever areas where there is no support.

G. MPC Cage with Replaceable Rollers

Preferably all active components of the MPC can be removed while under load (from the riser) to achieve higher reliability of performance of the system. Referring to FIGS. 12, 12A, and 12B, the MPC Cage 100 holds 8 rows of 8 rollers, or a total of 64 rollers. The most likely roller to fail is a roller which is under load. The inventive method to accomplish the removal of the loaded and failed roller is to remove the set of 8 commonly mounted rollers on a Rocker Arm Assembly 116. That assembly is removably bolted to a center ring 118. First, those bolts are removed from the associated Rocker Assembly. Next, the bolts are removed from a Rocker Assembly on each side of the one to be removed, and finally the bolts are reinserted into center ring holes (the ones at each side of the defective Rocker Assembly) which are threaded. Insertion and torquing of the bolts will push on the back of that Rocker Assembly and displace it forward toward the center of the Cage 100. As the Rocker Assemblies on each side of the Rocker Assembly to be removed are displaced, towards the center of the Cage, the loading on the defective Rocker Assembly is relaxed. The unloaded Rocker Assembly is then ready to be lifted out for servicing.

H. MPC Load Cell Mechanism

Figure 15:
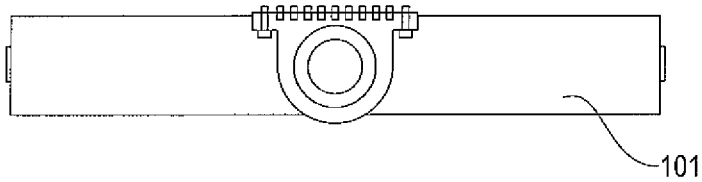
FIG. 15 is a rear view of the Yoke of the Moon pool Centralizer.
Figure 15A:
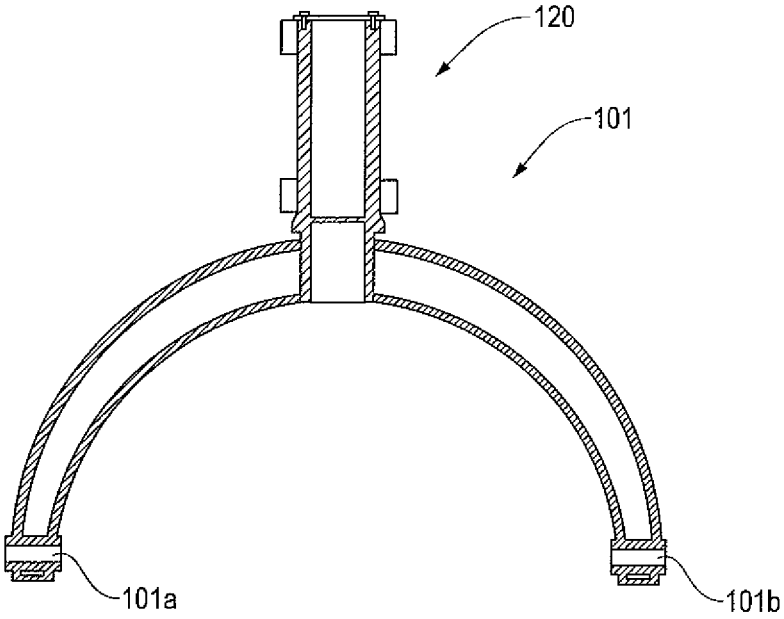
FIG. 15A is a half section of the Yoke of the Moon pool Centralizer taken at the central horizontal plane.
Figure 15B:
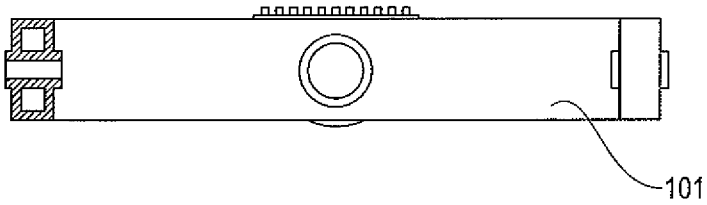
FIG. 15B is a front view of the Yoke of the Moon pool Centralizer with a partial section taken on the left side showing the pivot location for the Cage of the Moon pool Centralizer.
Figure 15C:
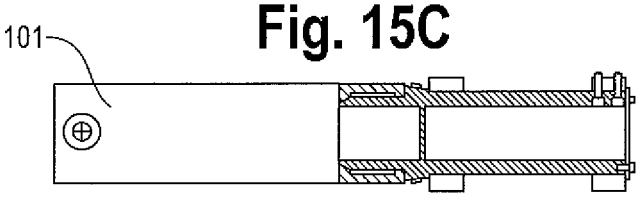
FIG. 15C is a half section of the Yoke of the Moon pool Centralizer as viewed from the right side of FIG. 15B.

The loading of the drilling riser on the Moon Pool Centralizer (see FIGS. 10A and 10B) is measured in the neck area 120 of the Yoke 101 near the MPC Base 102 as seen in FIG. 15A. Preferably, redundancy and field replacement of the load cells is provided due to relative inaccessibility of the components.

In one embodiment, a four segment ring is provided to go around the neck 120 of the Yoke 101 like a collar. A slight groove is provided in the neck of the Yoke to provide a protected surface (See FIG. 15C) and four longitudinal grooves are milled on the neck of the Yoke at 0°, 90°, 180° and 270°. Four quadrant rings are provided, each with a key to engage "slots" and provide accurate repeatable positioning. On the inner surface of each of the quadrants, dual sets of strain gauges are installed of the type which have "needle points" which engage the opposing surface. This engagement of the opposing surfaces, on the Yoke, allows the quadrants to measure the strain and therefore the stress in the Yoke itself.

I. MPC Quadrant Cameras to Centralize Tension Ring

Figure 14:
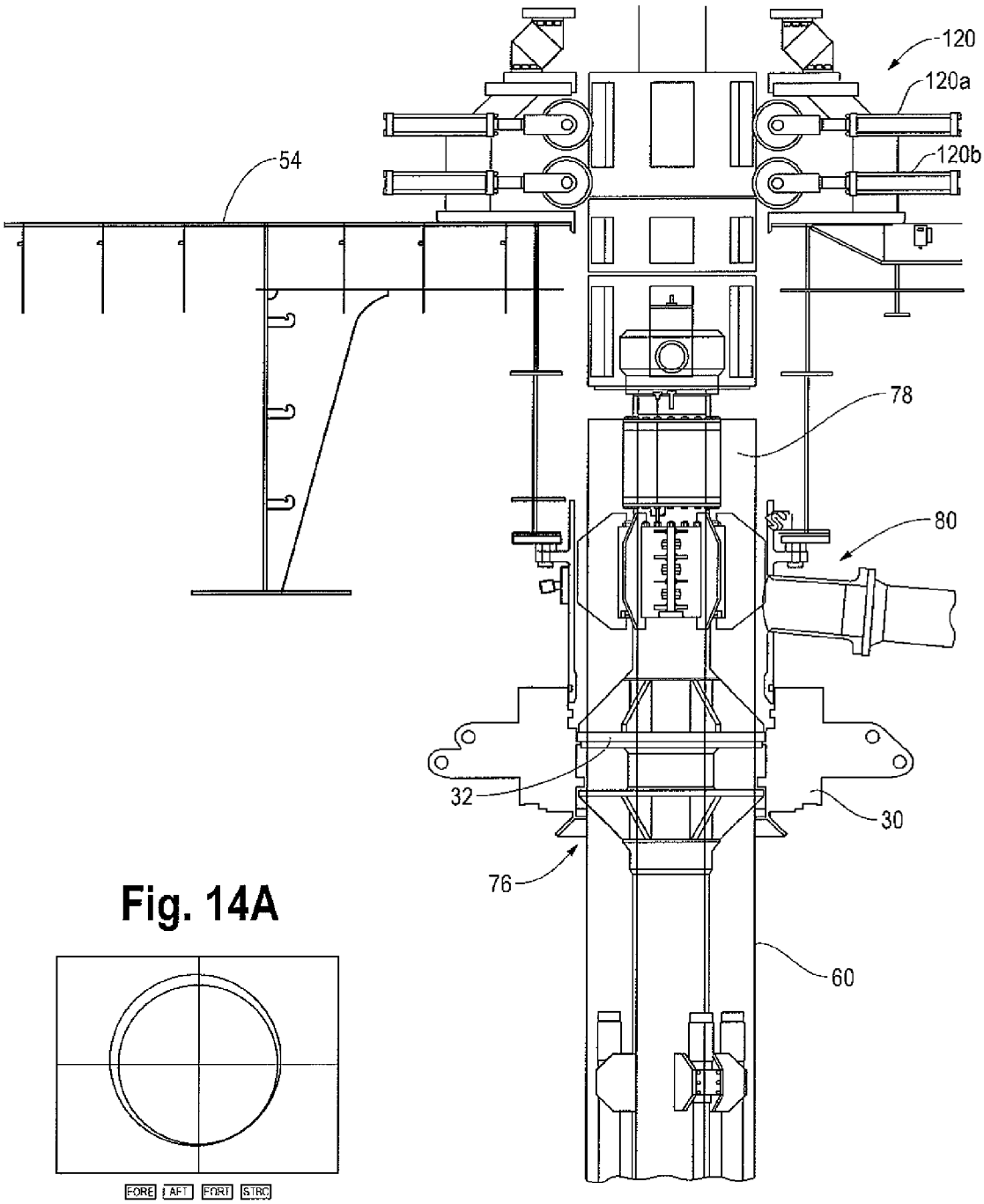
FIG. 14 is an inside view of a half-section showing the drilling riser telescopic joint tension ring being brought up to land on the bottom of the diverter housing and being viewed by four cameras.

Referring to FIG. 14, as the Tension Ring 30 connected to the Telescopic Joint Load Flange 32 is pulled up to its storage position on the bottom of the Diverter Housing 80, it often must be centralized to within ¼". In other words, the problem in the ThunderHorse situation, is inserting a 58.50" O.D. Load Ring into the 59.00" I.D. of the Diverter Housing.

Figure 14A:
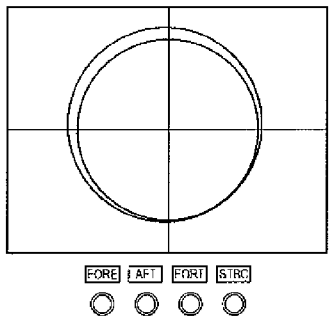
FIG. 14A shows a screen with composite views of the four cameras observing the approaching tension ring and showing four buttons to adjust the position of the Moon pool Centralizer to center the tension ring for engagement with the bottom of the diverter housing.

Making this engagement by trial and error, with lines tugging on the drilling riser and/or tilting the vessel 50 to help in the engagement is undesirable. In accordance with the present invention, four TV cameras (mounted on the Diverter Housing) are used to look downwardly while making this engagement. The cameras are not mounted fore, aft, port, and starboard; but rather at positions 45 degrees between those positions. The benefit of this is that the four images can be put onto a single TV screen and will approximate a circle (see FIG. 14A). With this image, it is relatively easy for an operator to know which way to move the drilling riser to safely make the engagement. Adjusting the position of the drilling riser is not by slowly moving of the entire rig, but rather by simple movement of the Moon Pool Centralizer, pivoting off the stationary position of the Drill Floor Centralizer above.

J. DFC with Step Over Support Flange and Retrieval Joint

Control of the drilling riser is based upon having load bearing rollers engage the outer diameter (e.g., 52.25" for ThunderHorse) of the flotation foam, any tracks on slick joints which simulate that diameter, and the Roto-Tracks 82. For this to work, all parts of the drilling riser 60 will have to be increased to diameter (52.25"), or decreased to that diameter. This can be achieved in all areas of the riser structure with one important exception. The Support/Load Flange 32 on the Telescopic Joint 76 is a critical load support means and can not be conveniently modified. For ThunderHorse, it is a 58.50" diameter flange and presents a substantial obstacle to the normally accepting 52.25" rollers at the drill floor.

Figure 6:
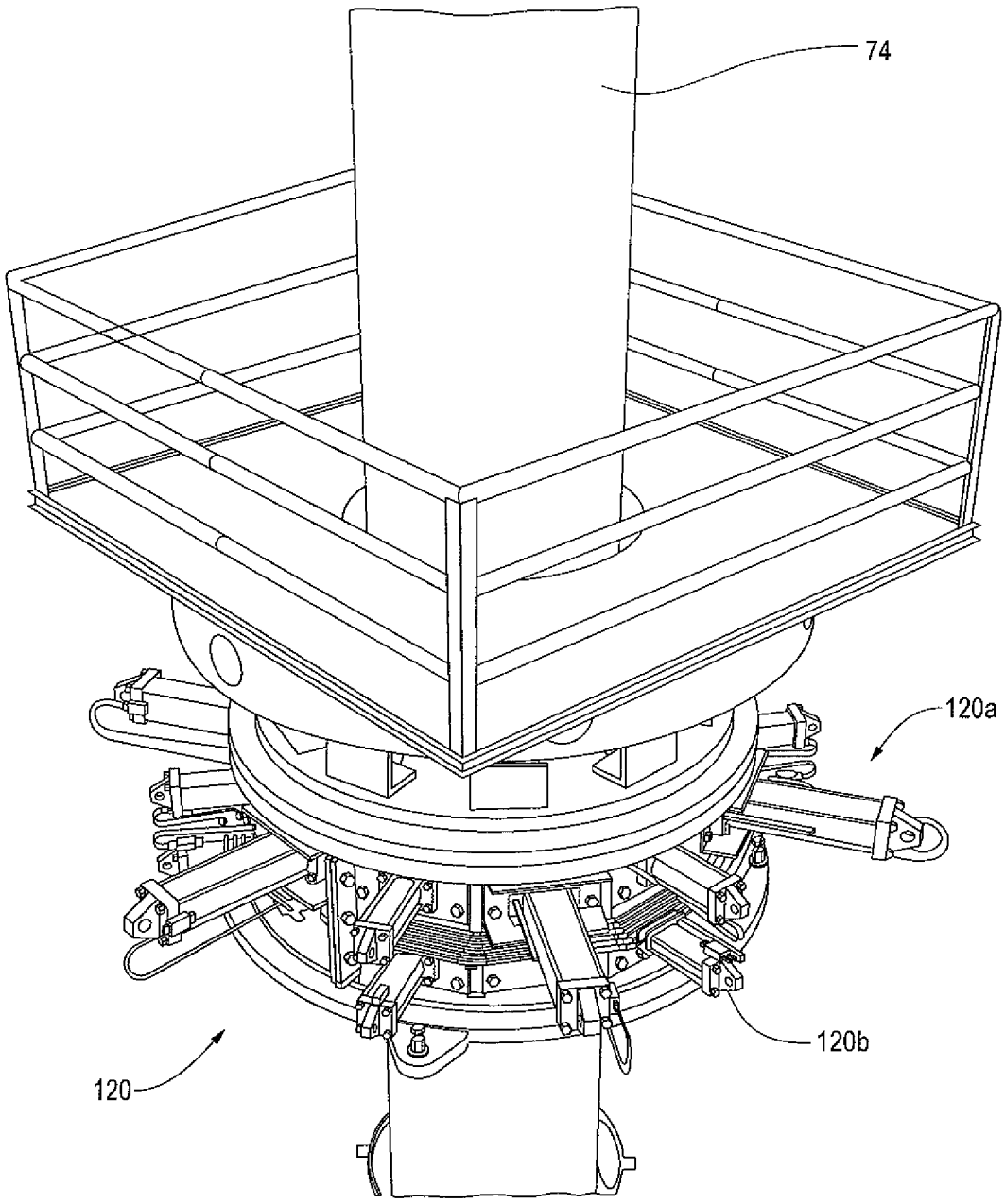
FIG. 6 is a pictorial view of the Drilling Floor Centralizer (DFC) with a drilling riser gimbal, spider, and work basket landed on the top.
Figure 7:
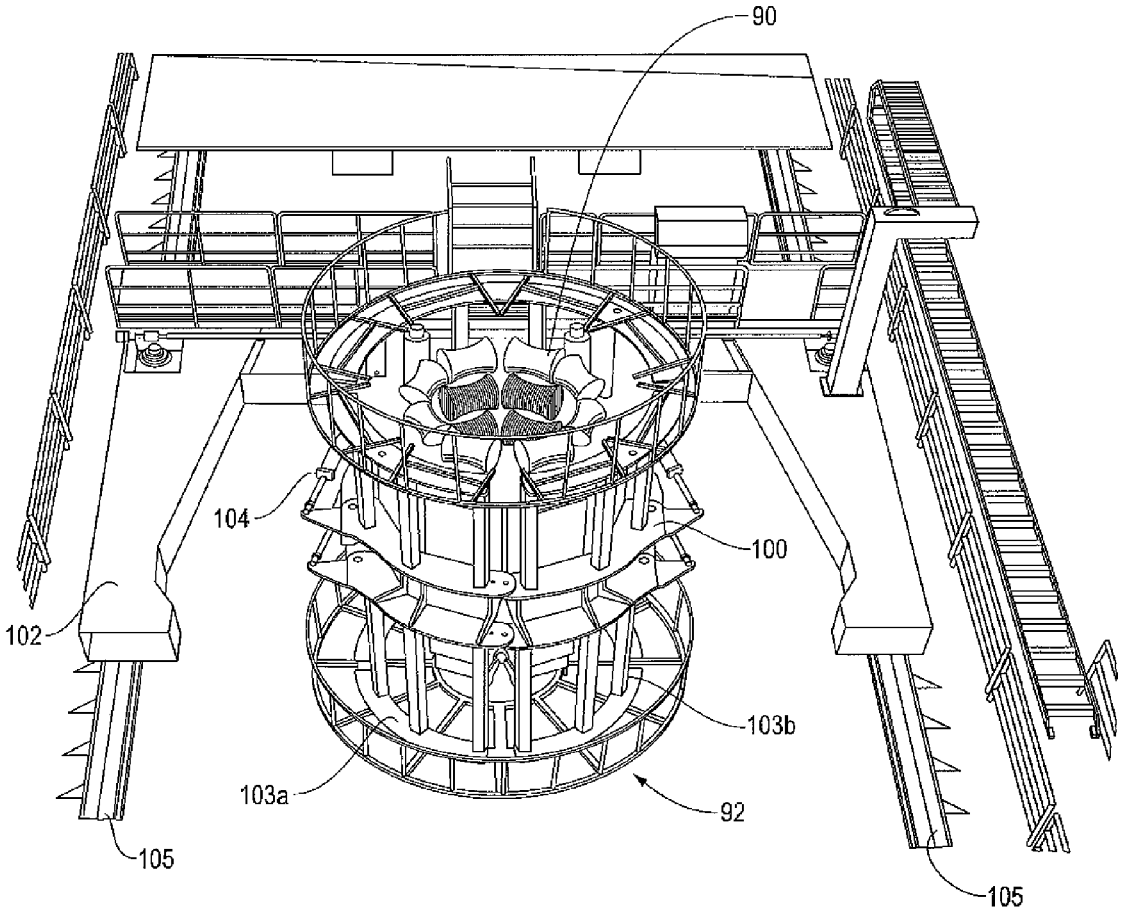
FIG. 7 is a perspective view of the Moon pool Centralizer (MPC)
Figure 8:
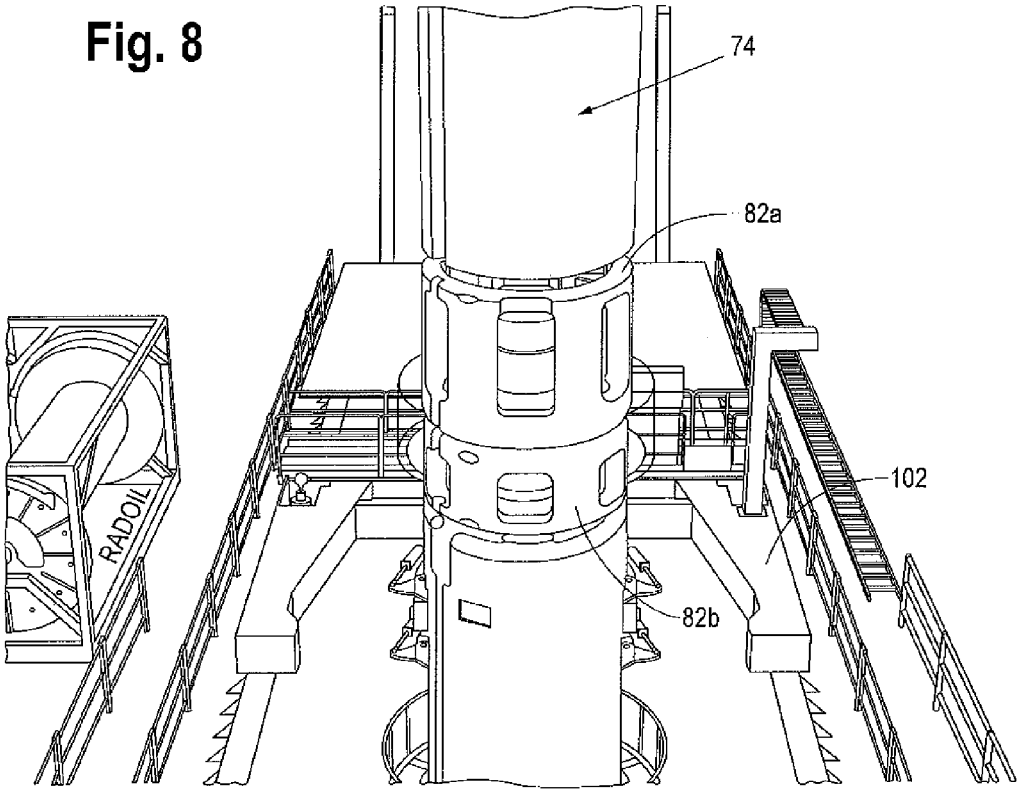
FIG. 8 is a pictorial view of the drilling riser with Roto-Tracks passing through the moon pool area.
Figure 16B:
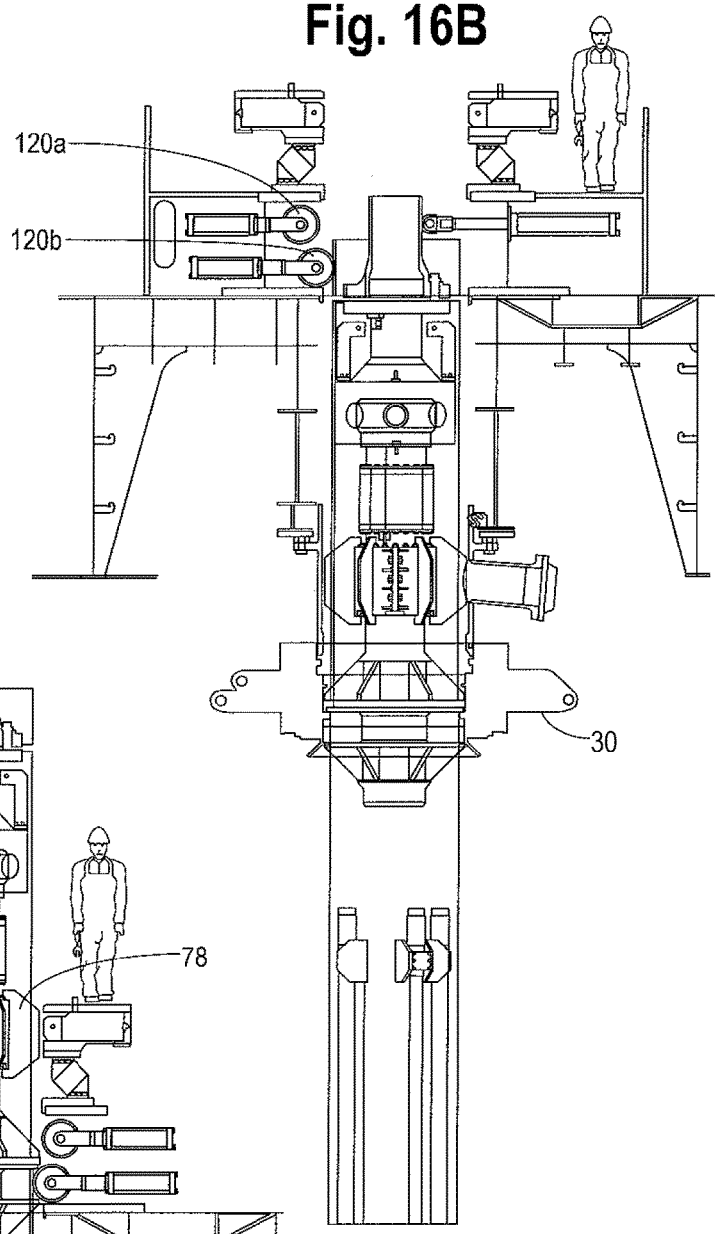
FIG. 16B shows the change of handling the side load on the drilling riser by having a first set of rollers on the right extending a distance to engage the bare pipe of the running string and a second set of rollers shown extending a lesser distance on the left to engage the diameter of the flotation modules.
Figure 16A:
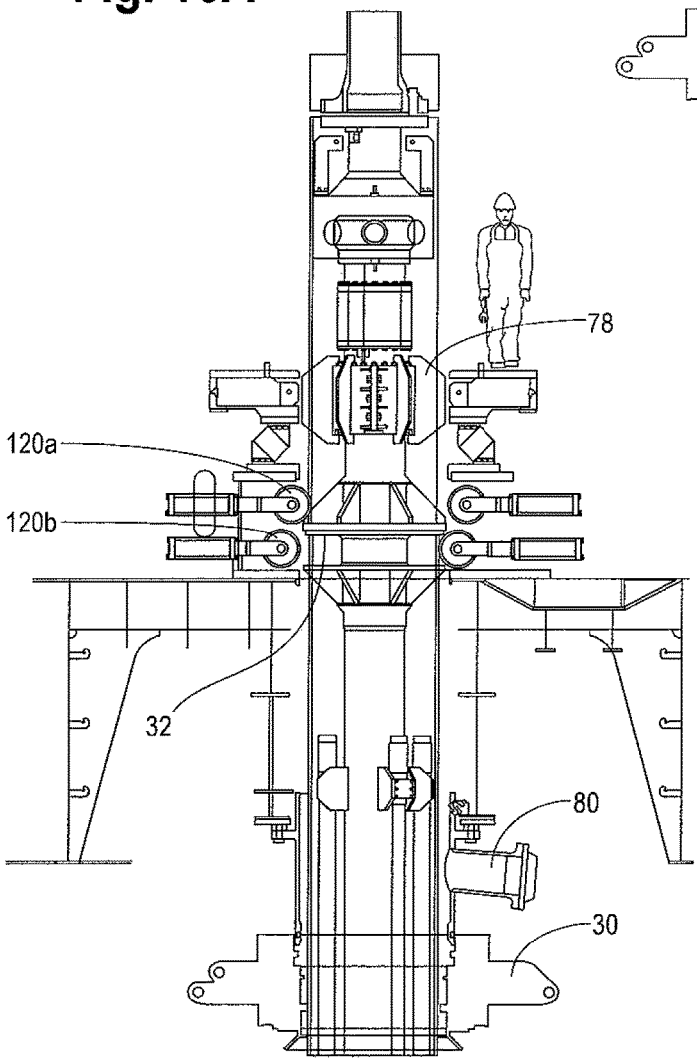
FIG. 16A shows the method of raising the drilling riser telescopic joint past the rollers on the Drill Floor Centralizer when under side load by positioning the as shown on the left for up to a point and then positioning the rollers as shown on the right.
Figure 17A:
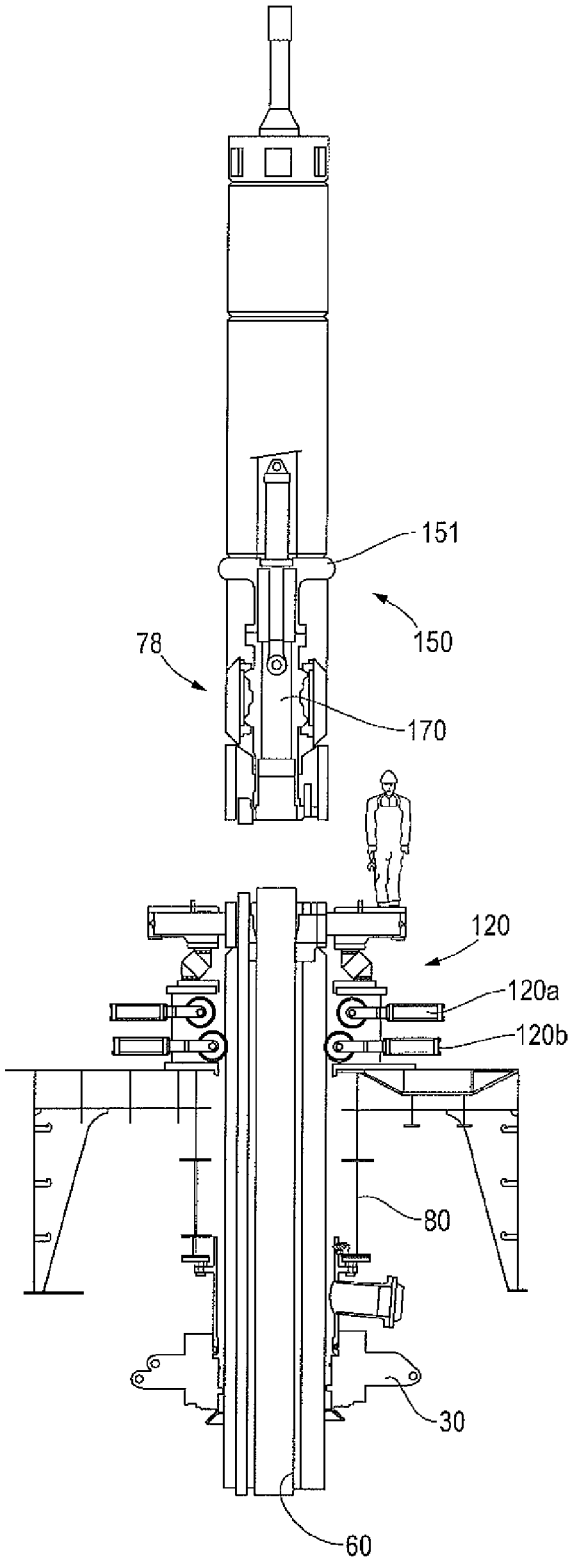
FIG. 17A shows lowering the Emergency Hangoff Tool to the top of the drilling riser which is landed on the drilling riser spider above the Drill Floor Centralizer.
Figure 17B:
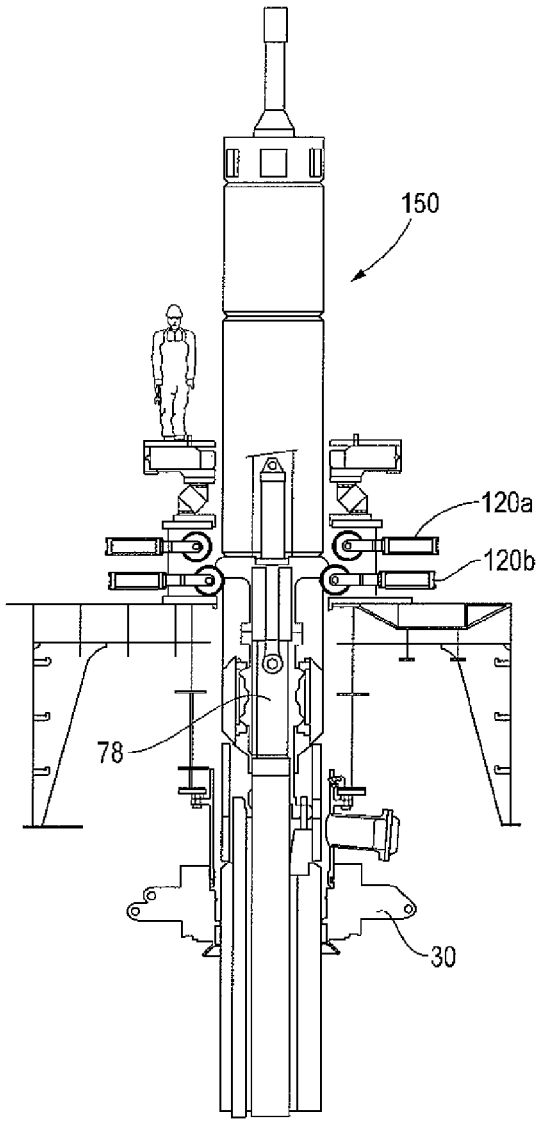
FIG. 17B shows lowering support shoulder on the Emergency Hangoff Tool to immediately above the lower rollers on the Drill Floor Centralizer.
Figure 17C:
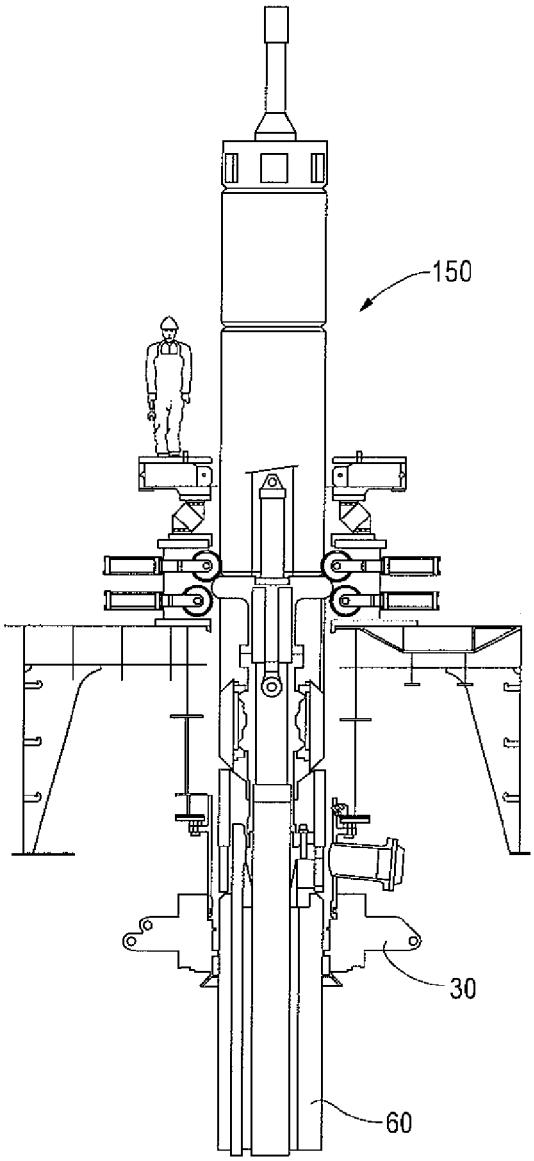
FIG. 17C shows the upper rollers engaged and then the lower rollers on the Drill Floor Centralizer retracted to allow further movement down.
Figure 17D:
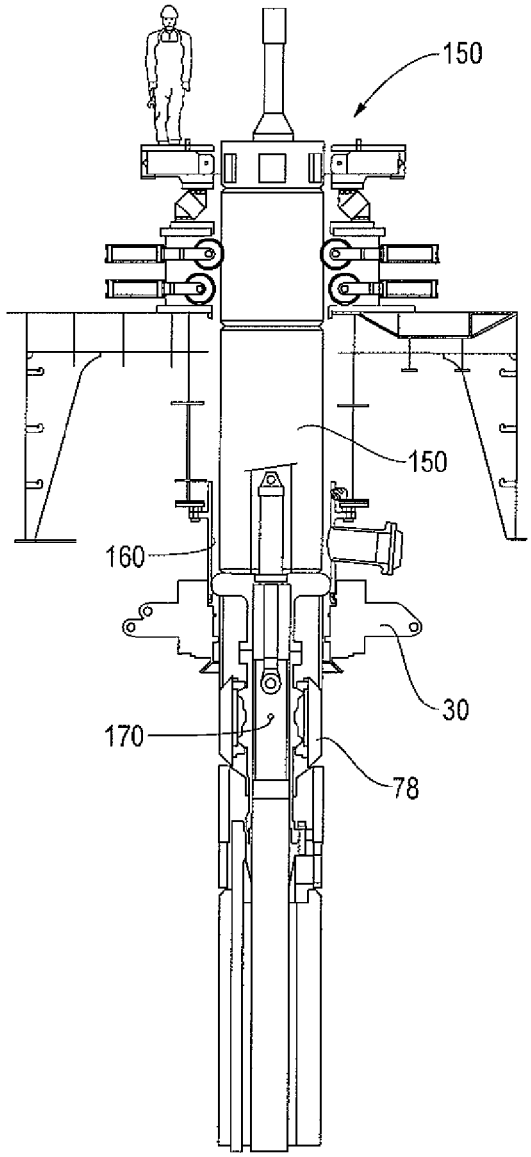
FIG. 17D shows the Emergency Hangoff Tool lowered until the support shoulder has engaged a mating shoulder on the diverter housing.
Figure 17E:
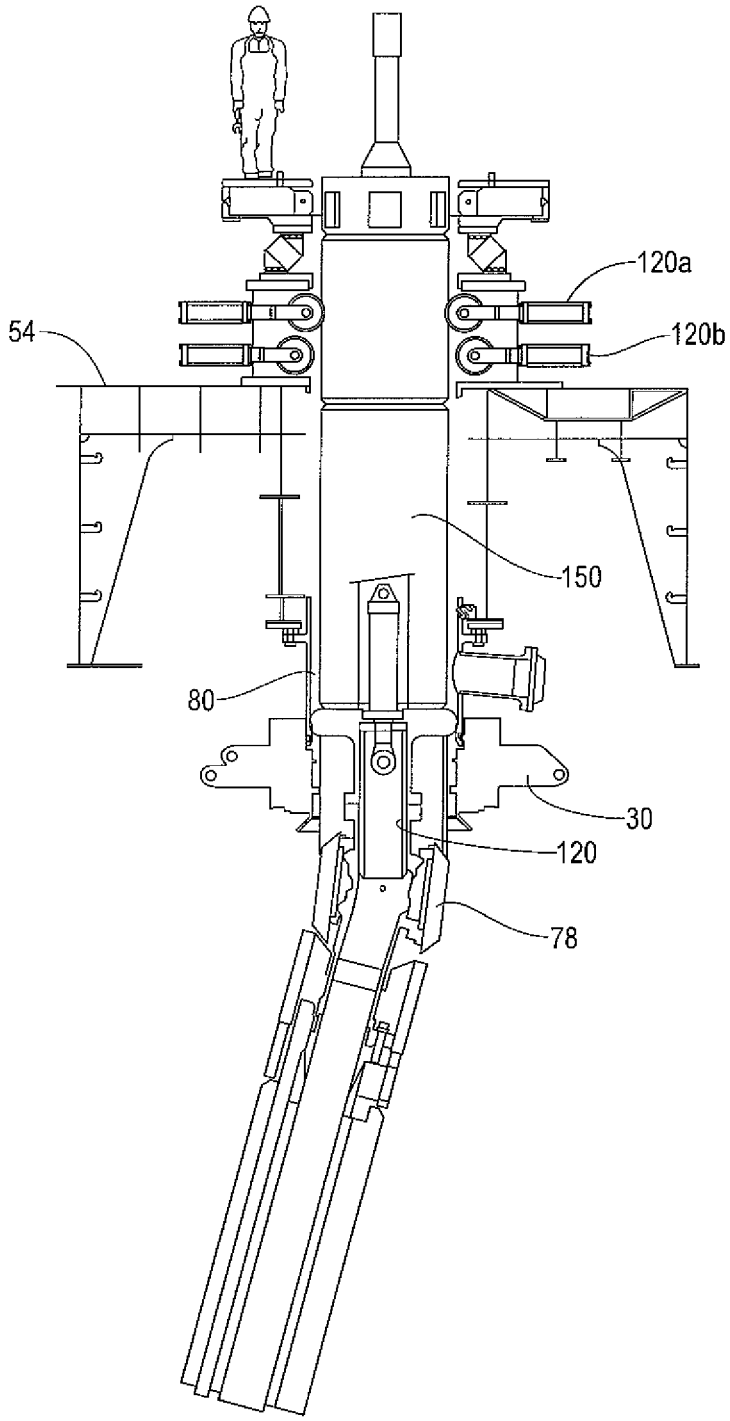
FIG. 17E shows the lockout pin on the Emergency Hangoff Tool lifted to disengage allowing the flex joint to flex as is required during emergency hangoffs.

Referring to FIGS. 6, 16A and 16B, this conundrum is resolved by providing Drilling Floor Centralizer 120 having a double set of axially movable, vertically separated rollers 120*a* and 120*b*. These rollers are operated as follows:

The upper DFC rollers 120*a* are moved inwardly to form a controlling diameter slightly larger than 52.25";

The lower DFC rollers 120*b* are retracted out of the way;

The Load Flange 32 is brought up to immediately below the upper DFC rollers;

Drilling riser movement is stopped;

The lower DFC rollers 120*b* are engaged to the same diameter (e.g., slightly larger than 52.25") and; then The upper DFC rollers are retracted (See FIG. 16B).

The Telescopic Joint 76 on the riser can then continue its upward travel. This is not a problem with the Moon Pool Centralizer as the Load Flange is typically operated above the Moon Pool Centralizer.

When drilling riser recovery begins, the Inner Barrel of the telescopic joint is collapsed down to the Outer Barrel using a 21" OD. Retrieval Joint.

When the drilling riser starts to move up, a change in diameter occurs when the transition is made as the lower end of the Retrieval Joint approaches the Drill Floor Centralizer. At this time the DFC must transition between:

being under control in guiding a 21" diameter Retrieval Joint, to being under control in guiding a 52.25" diameter track on the Telescopic Joint.

K. DFC Load Cell Mechanism

The DFC 120 is located on the top of the rotary table at the rig floor 54 using a laminate bearing which allows slight movement in the radial directions with low and predictable horizontal forces. In one embodiment, three pads are provided to engage the internal diameter of the rotary table on three places separated by 120 degrees. When first landed, the pads are slightly preloaded by bolts to the level to which they are calibrated. At that time, increases and/or decreases in the loads on the three load cells can be computed to indicate the side load on the DFC. In BP America's ThunderHorse facility, loads (e.g., 100,000 lb) on the rollers of the Drill Floor Centralizer can be measured in any direction, irrespective of which rollers are being used.

L. Emergency Hangoff

In the event that the entire riser cannot be pulled to the surface before a hurricane, for example, impairs the operation of the drilling facility, an Emergency Handoff Tool 150 is provided (see FIGS. 17A through 17E). This tool allows the drilling riser 60 (and BOP stack below) to be "hung off" in the best situation that is practical under the circumstances. Preferably, the riser is hung off with its Flex Joint 78 immediately below the Diverter Housing 80 to handle the angular displacements which may occur during hurricane situations.

Figure 3A:
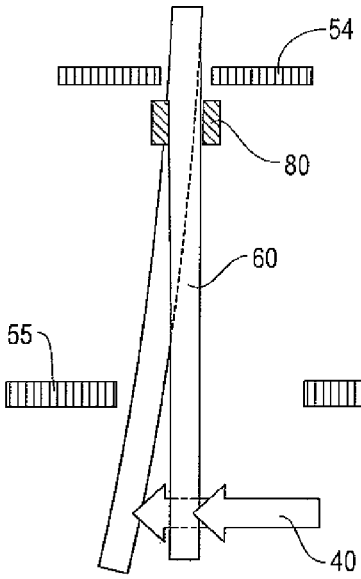
FIG. 3A shows the current forces on a drilling riser, with the drilling riser being displaced off to the left and loading against the rig floor equipment.
Figure 3B:
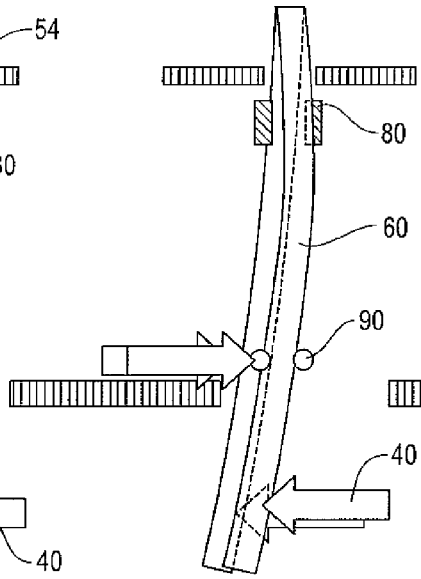
FIG. 3B shows the Moon pool Centralizer pushing the riser to the right to offset the current forces.
Figure 3C:
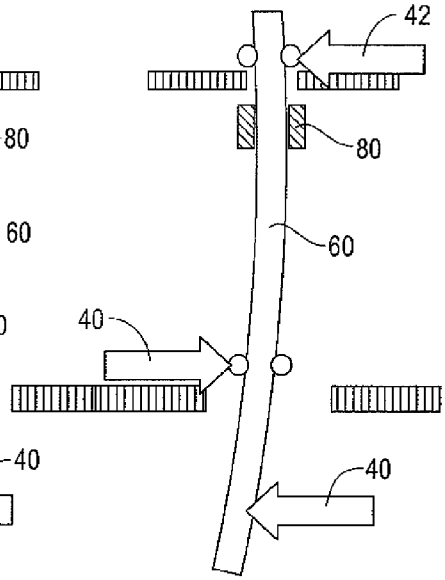
FIG. 3C shows the resultant reaction force at the rig floor and the drill floor centralizer to offset this force.

Prior to Emergency Hangoff, a high force is expected to exist against the MPC in a first direction 40 and a high force 42 will be imparted to the DFC in the opposite direction (see FIGS. 3A, 3B and 3C). If a Flex Joint is simply installed in the string and lowered through the Diverter Housing, the unit could bind as it runs through the Diverter Housing 80. There are open spaces and square shoulders between the top of the Diverter Housing 80 and the bottom of the rotary table which will act as positive stops. This is in addition to binding due to moment loadings.

The Emergency Hangoff Tool 150 comprises a Lockout Pin 170 inserted into the center of the Flex Joint 76 to prevent its "flexing" during the running procedure. Once in place below the Diverter Housing, the Lockout Pin is hydraulically pulled to allow the Flex Joint to flex. Once the Lockout Pin is removed, the MPC can move the riser to a neutral position and release it.

Similarly, when the hurricane has passed, the MPC will go to the current location of the drilling riser 60 and bring it back to a position immediately below the Diverter Housing (DH) so the Lockout Pin can be reinstalled, and the Emergency Hangoff Tool can be recovered.

FIGS. 17A through 17E illustrate these steps:

Land a Riser Hangoff Tool 150 on the top of the Riser String;

Lower the Landing Shoulder 151 to above the lower rollers 120*b* of the DFC;

Close the upper rollers 120*a* and open the lower rollers;

Land a Riser Hangoff Tool 150 on the shoulder 160 of the DH 80; and

Apply hydraulic pressure to release the Lockout Pin 170 and allow the MPC to move to a neutral location thereby releasing the riser.

From the foregoing description, it will be observed that numerous variations, alternatives and modifications will be apparent to those skilled in the art. Although the inventions have been described in the context of semi-submersible facility, the principles of the invention are equally applicable to the other marine faculties. In particular, the Roto-Track concept is applicable to the wide variety of risers and without necessarily being limited to the DFC and/or the MPC herein described. It is compatible with riser sections comprising slick joints. Accordingly, this description is to be construed as illustrative only and is for the purpose of teaching those skilled in the art the manner of carrying out the invention. Various changes may be made in the shape, materials, size and arrangement of parts. Moreover, equivalent elements may be substituted for those illustrated and described. Many parts can be reversed and certain features of the invention may be used independently of other features of the invention. For example, the emergency hang-off device is optional. Thus, it will be appreciated that various modifications, alternatives, variations, and changes may be made without departing from the spirit and scope of the invention as defined in the appended claims. It is, of course, intended to cover by the appended claims all such modifications involved within the scope of the claims.

That which is claimed is:

1. In an offshore drilling facility including a drilling floor, a diverter housing carried by the drilling floor, a moon-pool floor located below the drilling floor, and a string of at least two drilling riser sections connected end to end and that extend through the diverter housing and the moon-pool, each drilling riser section having a box end, an opposite pin end, and an outer diameter ends that is less than the overall outer diameter between the ends, apparatus comprising:

a drilling floor centralizer carried by the drilling floor and configured to receive and centralize the upper end of the string of drilling riser sections;

a moonpool centralizer carried by the moonpool floor and configured to receive and centralize at least a portion of the string of riser sections; and a first roto-track disposed about and removably coupled to the pin end of one drilling riser section and a second roto track disposed about and removably coupled to the box end of the adjacent drilling riser section, the first roto-track and the second roto-track each being disposed at an outer diameter equal to the outer diameter of the drilling riser sections between the ends of the drilling risers sections;

wherein the first roto-track and the second roto-track are coupled end to end and span a threaded connection between the box end and the pin end of two adjacent drilling riser sections;

wherein at least one of the first and the second roto-track includes a window for accessing at least a portion of the interior of the adjacent ends of two drilling riser sections.

2. The apparatus of claim 1, further including a plurality of rollers, carried by said moonpool centralizer, for supporting generally vertical movement of the string of drilling riser sections, the first roto-track, and the second roto-track.

3. The apparatus of claim 2, further including a plurality of rocker arms, at least one rocker arm carrying two of said rollers, vertically and one above the other.

4. The apparatus of claim 2, wherein said rollers generally encircle at least a portion of the periphery of a drilling riser that is located in said moonpool centralizer.

5. The apparatus of claim 2, wherein said moonpool centralizer comprises a cage for locating said rollers around at least a portion of the exterior of a drilling riser, said cage comprising:

a generally fixed section carrying at least one of said rollers and defining a generally arcuate opening therein for receiving a portion of a drilling riser therein;

a movable section carrying at least one of said rollers, fitting within said arcuate opening, and having an open position and a closed position; and means, connected to said fixed section and to said movable section, for moving said movable section between said open position and said closed position.

6. The apparatus of claim 5, wherein said cage is carried by the moonpool floor and is adapted for movement transversely thereon.

7. The apparatus of claim 6, wherein said cage is carried by the moonpool floor for movement to at least one of port to starboard and bow to stem of the drilling facility.

8. The apparatus of claim 5, wherein the cage is gimbaledly carried by the moonpool floor.

9. The apparatus of claim 8, wherein said cage is carried by the moonpool floor for gimbaled movement in at least one of the roll and pitch axes of the drilling facility.

10. The apparatus of claim 5, wherein each roto-track is generally in the shape of a right cylinder having a predetermined length; and wherein said cage is generally in the shape of a right cylinder having a height at least exceeding said predetermined length of each roto-track.

11. The apparatus of claim 10, wherein each roto-track comprises:

at least two arcuate segments which when connected encompass adjacent ends of two drilling risers;

means for removably connecting said segments while permitting at least limited rotation around said adjacent ends.

12. The apparatus of claim 5, wherein said cage comprises a plurality of circumferentially and axially disposed rollers that define a central opening approximating the outer diameter of the drilling riser.

13. The apparatus of claim 12, wherein said cage comprises a plurality of axially extending tracks, each track having a plurality of rocker arms and each rocker arm carrying at least two of said rollers.

14. The apparatus of claim 13, wherein at least one of said tracks is removably connected to said cage.

15. The apparatus of claim 5, wherein said arcuate opening is sufficiently large for a drilling riser to traverse into and out of said cage.

16. The apparatus of claim 15, wherein said roto-tracks: have a first rotated position and a second rotated position; are generally in the shape of a right cylinder having a hollow interior; and have a peripheral opening between its interior from its exterior, said roto-tracks in said first rotated position providing access to at least a portion of one adjacent end of the drilling riser section, said roto-tracks in said second rotated position providing a relatively smooth continuous bridge between the outer diameters of said adjacent drilling riser sections intermediate the ends of the drilling riser sections.

17. The apparatus of claim 1, wherein said moonpool centralizer comprises a frame carried by the moonpool floor for transversely moving said cage relative to the moonpool floor.

18. The apparatus of claim 17, wherein the moonpool floor comprises at least one toothed rail, and said frame comprises at least one motorized wheel having a plurality of teeth along its circumference that are adopted to mate with said rail for linear movement thereon.

19. The apparatus of claim 18, wherein said moonpool centralizer comprises a yoke, carried by said frame, for carrying said cage for at least limited rotational movement over two generally perpendicular axes.

20. The apparatus of claim 1, wherein said drilling floor centralizer comprises a plurality of rollers located radially and vertically around at least a portion of the periphery a drilling riser passing therethrough.

21. The apparatus of claim 20, wherein at least one of said plurality of rollers is adapted to move radially towards and away from the drilling riser.

22. The apparatus of claim 1, wherein said drilling floor centralizer comprises a first set of rollers located around at least one portion of the periphery of the drilling riser passing therethrough, and a second set of rollers located above said first set of rollers and around at least another portion of the periphery that drilling riser.

23. The apparatus of claim 1, wherein the first roto-track comprises a box end section and the second roto-track comprises a pin end section.

24. The apparatus of claim 1, wherein the outer diameter of a plurality of the drilling riser sections between their ends is defined by flotation means carried thereon for providing at least some positive buoyancy thereto.

25. The apparatus of claim 1, wherein the outer diameter of at least one drilling riser section intermediate its ends is defined by a cowling.

26. In an offshore drilling facility including a drilling deck, a diverter housing carried by the drilling deck, a moon-pool deck located below the drilling deck, and a string of at least two drilling riser sections connected end to end and that extend through the diverter housing and the moon-pool, each drilling riser section having a box end, an opposite pin end, and an outer diameter intermediate its ends that is greater than the outer diameter immediately adjacent its ends, apparatus comprising:

a drilling floor centralizer carried by the drilling deck and configured to engage the string of drilling riser sections at a first level with a plurality of first rollers;

a moonpool centralizer positioned in the vicinity of the moonpool and configured to engage a portion of the string of drilling riser sections at a second and relatively lower level with a plurality of second rollers;

at least one pin roto-track coupled to the pin end of one drilling riser section; and at least one box roto-track coupled to the box end of the adjacent drilling riser section, said pin roto-track and said box roto-track extending said outer diameter of each of said adjacent ends of the drilling riser sections to the outer diameter of said adjacent drilling riser sections intermediate its ends and providing a relatively smooth continuous track for said rollers;

wherein the moonpool centralizer has a central axis, a first end, and a second end opposite the first end, wherein the moonpool centralizer comprises a cage extending axially from the first end to the second end and the plurality of second rollers rotatably coupled to the cage, wherein the cage includes a body extending axially between the first end and the second end and a door extending axially between the first end and the second end, wherein the door is pivotally coupled to the body along an axis of rotation oriented parallel to the central axis of the moonpool centralizer;

wherein the door has an open position configured to allow the string of drilling riser sections to pass radially through the cage and a closed position configured to prevent the string of drilling riser sections from passing radially through the cage.

* * * * *